US006631966B2

(12) United States Patent
Watanabe et al.

(10) Patent No.: US 6,631,966 B2
(45) Date of Patent: Oct. 14, 2003

(54) RECORDING HEAD AND RECORDING APPARATUS WITH TEMPERATURE CONTROL

(75) Inventors: Itaru Watanabe, Kanagawa (JP); Mitsuru Kurata, Kanagawa (JP); Hiroki Tajima, Kanagawa (JP); Takayuki Ono, Kanagawa (JP); Hiroaki Shirakawa, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/986,805

(22) Filed: Nov. 13, 2001

(65) Prior Publication Data

US 2002/0057312 A1 May 16, 2002

(30) Foreign Application Priority Data

Nov. 13, 2000 (JP) ..... 2000-345024
Feb. 23, 2001 (JP) ..... 2001-048666

(51) Int. Cl.[7] ..... B41J 29/377; B41J 2/05
(52) U.S. Cl. ..... 347/18; 347/67
(58) Field of Search ..... 347/5, 17, 18, 347/14, 19, 23, 67, 63, 65; 165/80.4; 400/124.03, 124.13

(56) References Cited

U.S. PATENT DOCUMENTS 5,017,941 A * 5/1991 Drake ..... 347/18
5,818,516 A * 10/1998 Rezanka ..... 347/18

FOREIGN PATENT DOCUMENTS

| | | | |
|---|---|---|---|
| JP | 1-242257 | 9/1989 | ..... B41J/3/04 |
| JP | 2738697 | 1/1998 | ..... B41J/2/05 |
| JP | 10-44386 | 2/1998 | ..... B41J/2/01 |
| JP | 2000-141819 | 5/2000 | ..... B41J/29/377 |

* cited by examiner

*Primary Examiner*—Raquel Yvette Gordon
*Assistant Examiner*—Juanita Stephens
(74) *Attorney, Agent, or Firm*—Fitzpatrick, Cella, Harper & Scinto

(57) ABSTRACT

A liquid discharge head records by generating thermal energy to discharge ink from a discharge port onto a recording medium. The head is provided with a heat dissipating substrate positioned substantially parallel and adjacent to a discharge portion substrate, and a space, which communicates with the outside air, positioned at a surface of the heat dissipating substrate which is opposite the surface of the heat dissipating substrate facing the discharge portion substrate. The space extends in the scanning direction so as to facilitate air flow through the head during carriage movement in order to dissipate heat generated by the head during recording. A cooling fan may be provided to increase the air flow and the consequent heat dissipation.

18 Claims, 16 Drawing Sheets

RECORDING HEAD AND RECORDING APPARATUS WITH TEMPERATURE CONTROL

BACKGROUND OF THE INVENTION

1. Field of the Invention

The present invention relates to a recording apparatus of serial type, and more particularly to a recording head having a heat generating portion for generating thermal energy to be used for recording and an apparatus provided with such recording head.

2. Related Background Art

The recording apparatus of ink jet system executes recording by discharging a droplet of recording liquid (ink) from a discharge port of a recording head and depositing such droplet onto a recording medium. In the recording apparatus employing such ink jet system, for example a serial ink jet printer, the recording is executed by discharging ink from the recording head while it is moved in a main scanning direction and conveying the recording medium by a recording medium conveying member (roller) between the scanning motions.

Among the recording heads, there is known a recording head for discharging a micro droplet of liquid utilizing thermal energy generated for example by an electrothermal converting member and a recording head for discharging a liquid droplet by deflection with a pair of electrodes. Among these heads, the recording head discharging liquid droplet by utilizing thermal energy is provided with advantages such as that recording of a high resolution is possible because the ink discharging portions (discharge ports) can be arranged with a high density and that the entire recording apparatus can be easily compactized, and is therefore commercially utilized. FIG. 15 is a perspective view showing an example of a serial ink jet recording apparatus, in which the recording head thereof is provided with a head casing, having detachable ink tanks 50. The head casing 51 is provided, on a rear face thereof (opposite to a face on which the ink tank 50 is mounted), with an ink supply portion 55 having ink flow paths communicating with ink supply apertures of the ink tanks 50 respectively through liquid chambers, and discharge portions 52 are provided on the ink supply portion 55 across a support member (heat dissipating member) 54.

The ink supply portion 55 and the support member 54 are mutually fixed by adhesion, and the support member 54 and the discharge portions 52 are mutually fixed by adhesion. The support member 54 is provided with plural ink flow paths for supplying the discharge portions 52 respectively with inks, and these ink flow paths are respectively connected with those of the ink supply portion 55. Since the precision of the discharge portions 52 is extremely important, the support member 54 has to be composed of a material of high heat resistance and high flatness and is generally composed of a metal or a ceramic material.

Each discharge portion 52 is provided with plural discharge ports arranged with a predetermined pitch in a longitudinal direction (crossing the scanning direction (for example, perpendicularly)), and an energy conversion element such as an electrothermal converting element is provided for each discharge port. The discharge portion 52 is electrically connected with a flexible cable 53 through which electrical signals for driving the energy conversion elements are supplied from an unrepresented control unit. In order to reduce the electrical resistance, the flexible cable 53 usually has an area approximately equal to a discharge surface of the support member 54 (a surface of support member 54 facing discharge portions 52) and is so provided as to cover the discharge surface of the support member 54.

The recording head shown in FIG. 15 is provided with a discharge portion 52 for each ink tank 50, and the number of such ink tanks and discharge portions is variable depending on the specifications.

In the following there will be given a more detailed description of the structure of the discharge portion of the conventional recording head. FIGS. 16A and 16B are respectively a perspective view and an exploded perspective view of the discharge portion of a conventional recording head, wherein the discharge portion 52, the support member 54 and the ink supply member 55 are basically similar to those shown in FIG. 15 except for a difference in the shape and in the number of ink flow paths.

The support member 54 is provided with plural ink flow paths 54*a*, and the discharge portions 52 are fixed by adhesion on each of the ink flow paths 54*a*, respectively. The ink supply portion 55 is composed of a molded member (for example, of organic resinous material) and is provided with plural ink flow paths 55*a* respectively corresponding to the ink flow paths 54*a* of the support member 54, and the support member 54 is fixed by adhesion in such a manner that the corresponding ink flow paths are mutually connected. The adhesion between the discharge portions 52 and the support member 54, and between the support member 54 and the ink supply portion 55, is achieved by an adhesive material of a very high thermal conductivity.

Each discharge portion 52 is provided with plural discharge ports in the longitudinal direction thereof (crossing the scanning direction (for example, perpendicularly)), and an electrothermal converting element is provided for each discharge port. At ink discharge, an electrical pulse is applied according to drive data to the electrothermal converting element of each discharge port, whereby film boiling is generated in the ink and the ink is discharged from the discharge port by the growth of a bubble generated by the film boiling.

The heat generated in such ink discharge is considered to be dissipated principally by the following three processes:

(1) heat dissipation to the discharged ink itself;

(2) solid heat conduction from the discharge portions 52 to the support member 54 and the ink supply portion 55; and (3) heat dissipation from the discharge portions 52, the support member 54 and the ink supply portion 55 to the external space (air).

In the conventional recording head, as explained in the foregoing, the heat generated in the discharge portions 52 at ink discharge is partly taken away by the discharged ink droplet itself and is dissipated by solid heat conduction and heat dissipation. In the aforementioned conventional recording head, the heat movement is generally much faster and larger in the solid heat conduction to the support member 54 than in the heat dissipation to the air. Consequently the heat generated in the discharge portions 52 is immediately transmitted to the support member 54. However, since the material employed in the ink supply portion 54 generally has a low heat conductivity, the solid heat conduction from the support member 54 to the ink supply portion 55 is not performed effectively, so that the heat transmitted to the support member 54 is eventually dissipated from the surface thereof into the air. In this manner, the cooling or heat dissipation in the conventional recording head principally relies on the heat dissipation from the surfaces of the discharge portions 52 and the support member 54 except for the part of the heat dissipated by the discharged ink droplet itself. For this reason, heat tends to accumulate in the head and, since the heat capacity is not so large, there easily results an increase in the temperature. Especially in a configuration in which the surface of the support member 54 is covered by the flexible cable 53, heat tends to accumulate more in the head, thus leading to a further temperature increase, because an additional process of heat conduction from the support member 54 to the flexible cable 53 is required.

An excessive increase in the temperature of the head may result in the following drawbacks:

(1) ink cannot be discharged (non-discharge);

(2) bursting of ink droplet at discharge;

(3) accelerated kogation and deterioration of the electro-thermal converting element (heat generating member or heater); and (4) fluctuation of recording density in recording on a recording medium such as paper.

It is therefore an important issue how to suppress the temperature increase of the recording head.

The most common countermeasure against temperature increase is to provide a pause between the scanning motions when the recording head shows a certain temperature increase and to dissipate the heat during such pause. This method however requires a long pause for cooling, and the recording time required for each recording sheet is extended by such pause, thus resulting in a significant reduction in the recording speed.

It is effective to cool a recording head showing temperature increase by heat generation at ink discharge, with a fan, and there is already proposed a configuration in which a fan is fixed to a carriage supporting the recording head. In such configuration, however, the carriage becomes heavier because the fan is fixed thereto, and it becomes difficult to increase the driving frequency. Also, as the ink droplet becomes finer, the air flow generated by the fan and directed toward the recording head may result in an aberration in the landing position of the ink droplet and in ink drying in the discharge portions.

There is also conceived a method of air cooling the recording head with an air flow generated by the movement of the carriage, instead of employing the fan. As an example, Japanese Patent Application Laid-open No. 2000-141819 proposes a cooling mechanism having a cooling air path between a head heat dissipation plate provided in the head unit of the ink jet printer and an internal lateral wall of the carriage opposed to the aforementioned head heat dissipation plate. In this cooling mechanism, an air flow is generated in the cooling air path by the carriage movement, and the air flows along the surface of the head heat dissipating plate, thereby achieving efficient heat dissipation by the head heat dissipation plate. However, such cooling mechanism is insufficient for air cooling the vicinity of the ink discharge port having a large amount of heat within the head unit, because the head heat dissipation plate is provided in a position distant from the ink discharge port.

In addition to the foregoing, there have been proposed methods for cooling the recording head with liquid. As an example, Japanese patent No. 2738697 (Japanese Patent Application Laid-open No. 01-242257) proposes:

(1) method of winding a tube around the liquid discharge recording head and flowing cooling liquid in such tube;

(2) forming a liquid flow path in a substrate bearing the thermal energy generating portion and flowing liquid in such liquid flow path; and (3) forming the thermal energy generating portion on a substrate composed of a porous material and having a heat accumulating layer thereon and impregnating the porous material with cooling liquid.

However, these cooling methods inevitably complicate the apparatus and result in a high cost, because there are required means for supplying the tube, flow path or porous member with the cooling liquid and means for replacing and discarding the cooling liquid.

Also the recent progress in recording speed and in image quality results in an increase the density of the ink discharge nozzles and the input energy, and in a decrease in the heat dissipating space, thus leading to a situation more unfavorable for the temperature increase in the recording head. The issue of temperature increase in the recording head is becoming unavoidable also based on such technical background.

SUMMARY OF THE INVENTION

The present invention relates to a liquid discharge recording head for executing recording by moving in opposed relationship to a recording medium and discharging liquid from a discharge port, provided with energy generation means capable of generating thermal energy for discharging ink, a heat dissipating substrate positioned substantially parallel to the energy generation means and capable of transmitting the heat of the energy generation means, and a support member for supporting the heat dissipating substrate, the recording head further comprising a space continuous in the moving direction of the recording head between the support member and the rear surface of the heat dissipating substrate opposite to the surface thereof on which the energy generating means is provided. The present invention also relates to a recording apparatus provided with a carriage capable of supporting a liquid discharge recording head for executing recording by moving in opposed relationship to a recording medium and discharging liquid from a discharge port by thermal energy, wherein the recording head comprises a duct penetrating (extending) in a predetermined direction the surface of a member provided with means for generating thermal energy, the aforementioned surface being opposite to the surface on which the thermal energy generating means is provided.

According to the invention mentioned above, the heat generating portion can be cooled both from the head surface and from the inside of the head with the movement of the recording head.

In the present invention, in a configuration having a heat transporting means and a heat dissipating means, the heat accumulated inside the recording head among the heat generated in the heat generating portion is removed to the outside of the head by the heat transporting means and is radiated by the heat dissipating means.

Also, according to the present invention, as the recording head is opposed to a cooling fan in a predetermined position where the cooling fan causes an air flow in the duct or blows an air flow to the heat dissipating means, the head can be cooled more efficiently and within a shorter time in comparison with the conventional configuration employing an air cooling fan. Consequently, even if the recording head is excessively heated and is subjected to a forced air cooling operation with a cooling fan, cooling can be achieved within a short time and the recording speed is not sacrificed.

As explained in the foregoing, the present invention avoids complication of the apparatus and cost increase as in the conventionally employed cooling means, by merely providing the recording apparatus with a duct and more preferably with a cooling fan.

DETAILED DESCRIPTION OF THE PREFERRED EMBODIMENTS

Now the present invention will be clarified in detail by preferred embodiments thereof with reference to the accompanying drawings.

First Embodiment

Figure 1:
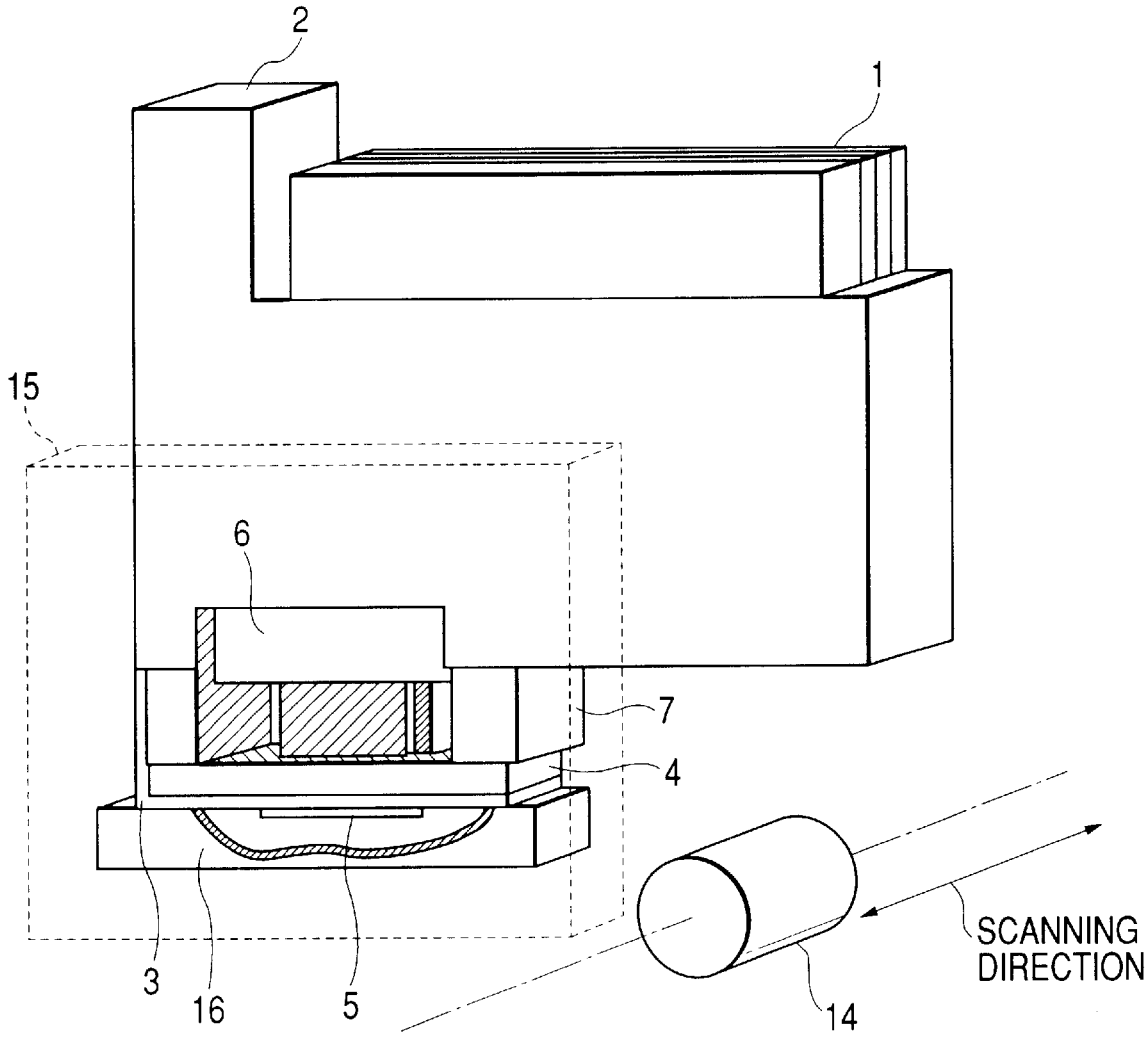
FIG. 1 is a view showing a recording head cooling mechanism for use in a recording apparatus, constituting a first embodiment of the present invention.

FIG. 1 shows a recording head cooling mechanism for use in a recording apparatus, constituting a first embodiment of the present invention.

Figure 15:
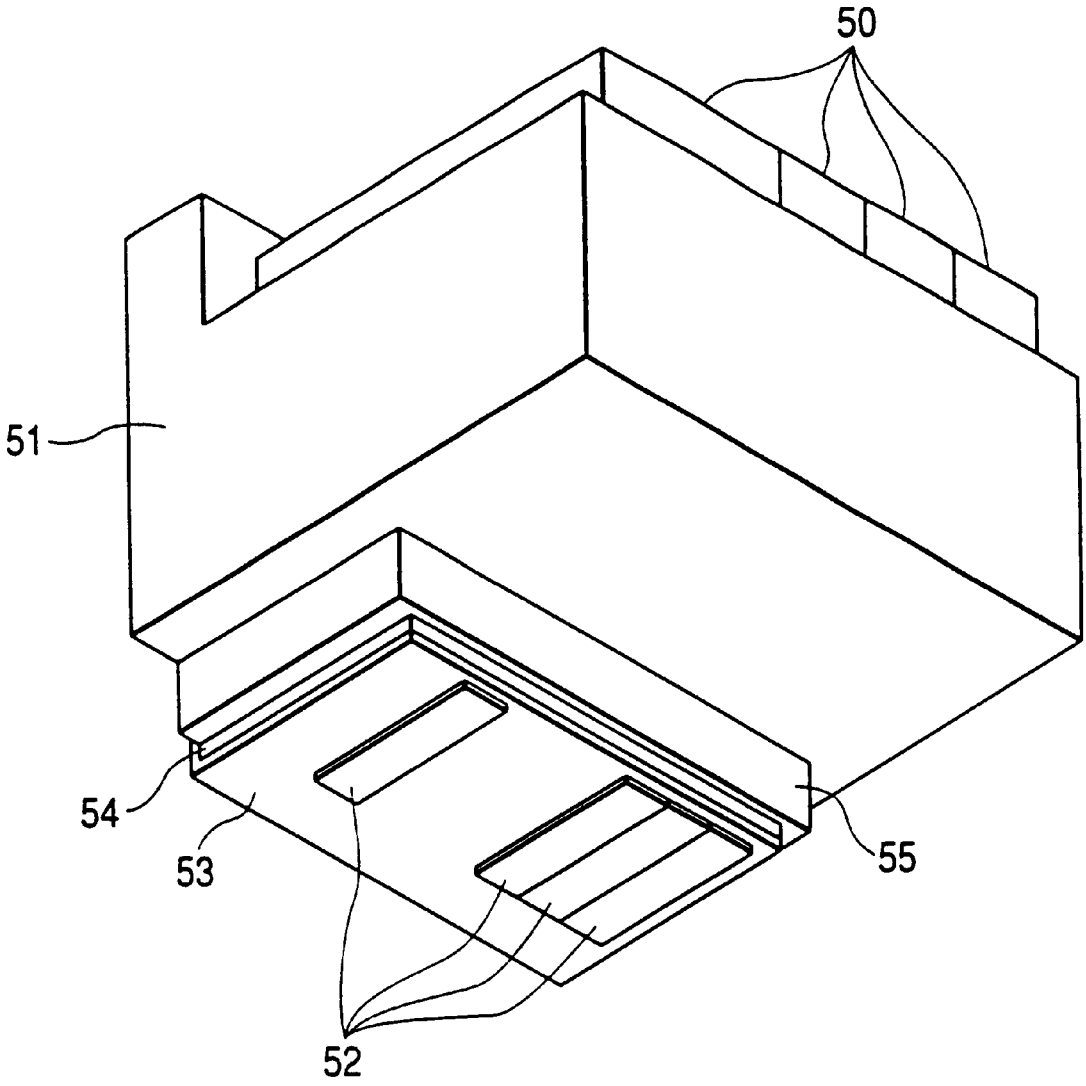
FIG. 15 PRIOR ART
FIG. 15 is a perspective view showing an example of the recording head of the serial ink jet recording apparatus shown in FIG. 14.
Figure 16B:
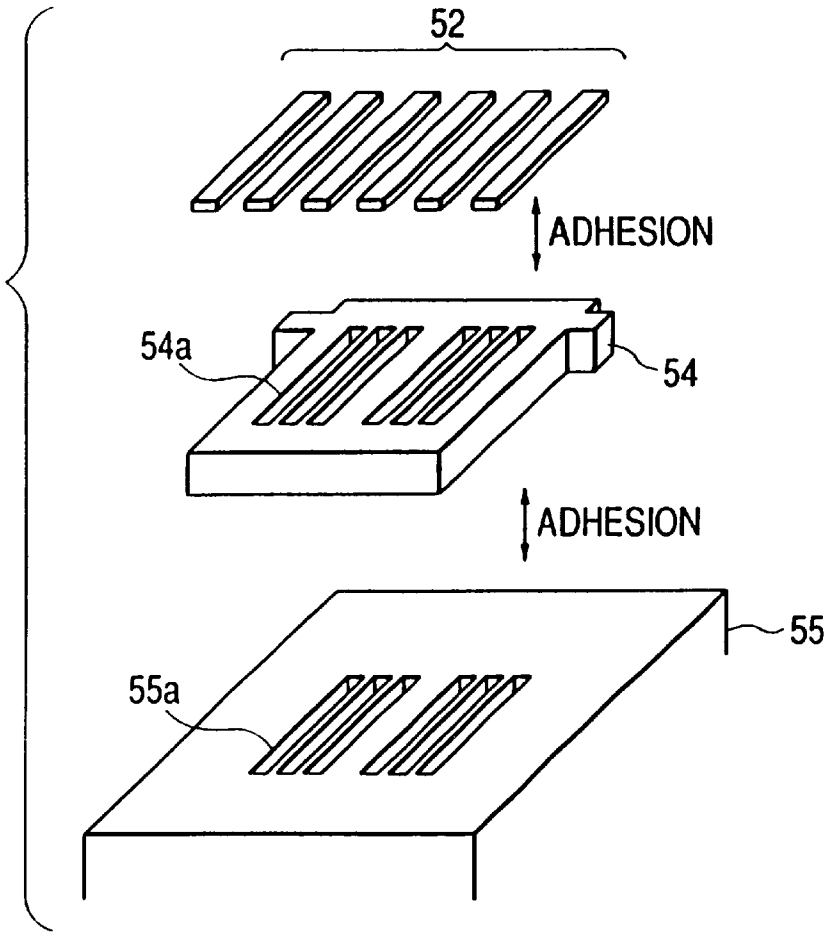
FIG. 16B PRIOR ART
FIGS. 16A and 16B are respectively a perspective view and an exploded perspective view of a discharging portion of the conventional recording head.
Figure 16A:
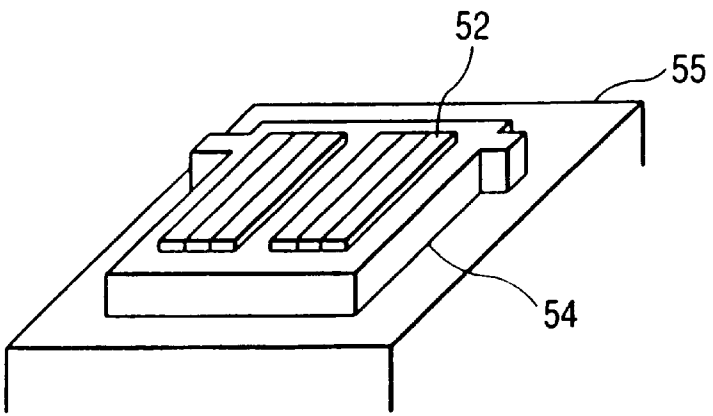
FIG. 16A PRIOR ART

The recording head of the recording apparatus of the present embodiment is provided with a head casing on which ink tanks 1 are detachably provided, and discharge portions 5 are provided, across a support member (heat dissipating member) 4, on an ink supply portion 7 at the rear surface of the head casing 2. A flexible cable 3 is connected to the discharge portions 5 and applies electric pulses according to drive data to electrothermal converting members 18 (shown in FIG. 2A) provided in the discharge portions 5 thereby generating film boiling in the ink and causing ink discharge from discharge ports by the growth of bubbles generated by such film boiling. Such configuration is basically same as that of the recording head shown in FIG. 15, but there is provided, as a new configuration for cooling the head, a duct 6 penetrating (extending) along a predetermined direction (scanning direction) in a portion where a support member 4 for the ink supply portion 7 is fixed.

Figure 2A:
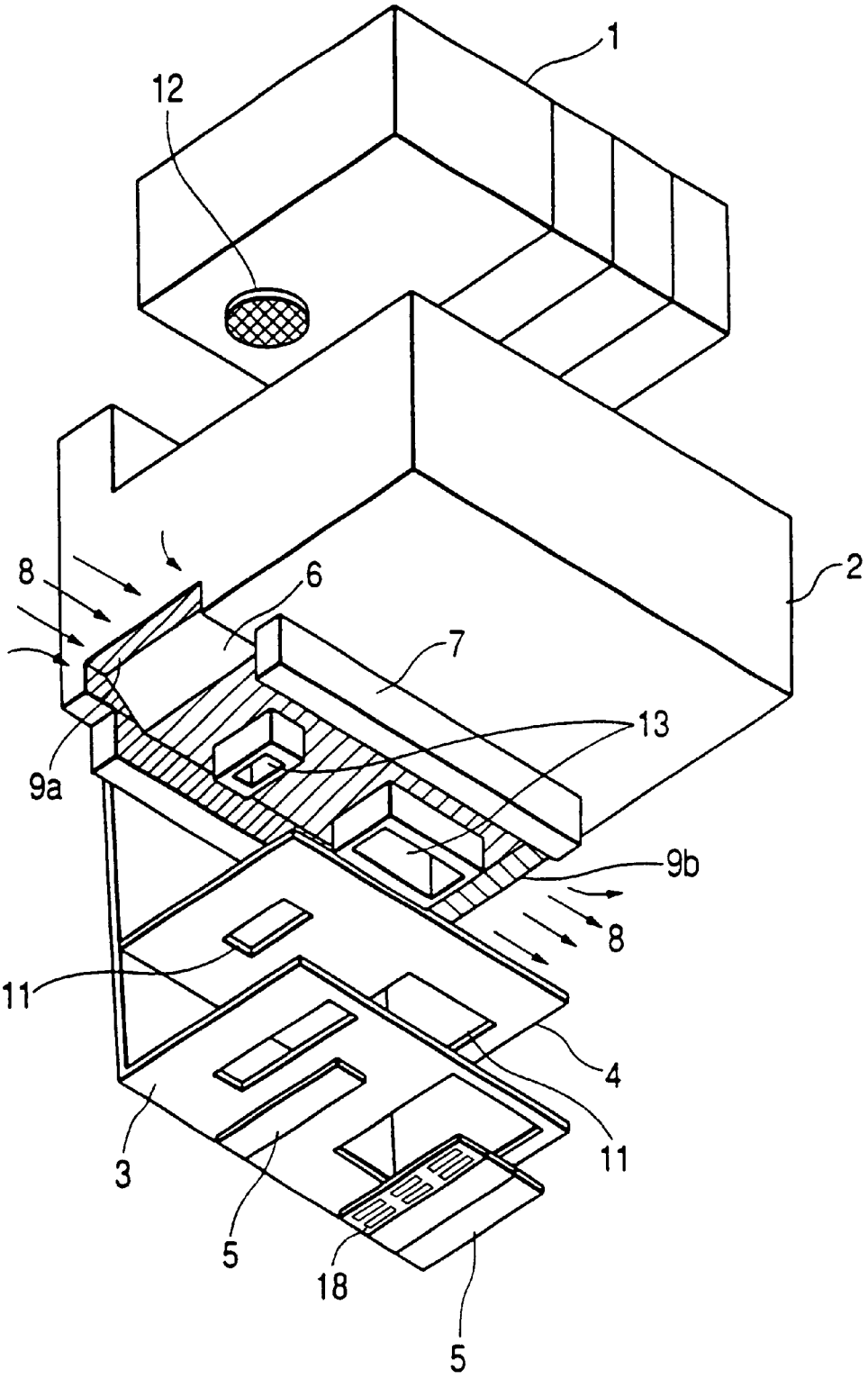
FIG. 2A is an exploded perspective view of the recording head shown in FIG. 1.

FIG. 2A is an exploded perspective view of the recording head shown in FIG. 1, wherein the ink tank 1 is provided, at a mounting face to the head casing 2, with a joint portion 12 in which a filter is provided for removing impurities from the ink in the supply thereof into the recording head. Inside the ink supply portion 7, there is provided an ink flow path 13 to be connected with the joint portion 12. The ink tank 1 is mounted in the head casing 2 in such a manner that the joint portion 12 coincides with the entrance of the ink flow path 13 in the ink supply portion 7.

The support member 4 is provided with an ink flow path 11 corresponding to the ink flow path 13 in the ink supply portion 7, and is fixed by adhesion to the ink supply portion 7 in such a manner that the entrance of the ink flow path 11 matches with the exit of the ink flow path 13.

The ink supply portion 7 is provided, in a portion thereof excluding the ink flow path 13, with a substantially square-U shaped cross section constituting a groove continuous in a direction, and, when the support member 4 is fixed, such groove portion constitutes a duct 6 penetrating (extending) in a predetermined direction. The duct 6 has an entrance 9*a* and an exit 9*b* of a diameter larger than the internal diameter of the duct 6, thereby enabling efficient intake of air into the duct 6.

Also, as illustrated, the entrance 9*a* and the exit 9*b* are provided with inclined portions in such a manner that the cross section becomes smaller toward the interior.

In image recording with the recording head of the above-described configuration, the discharge portions 5 are driven for discharging ink, whereby heat is generated from the energy conversion means, and the generated heat is transmitted to the support member 4. By mounting the recording head on the unrepresented carriage and moving the recording head along a main scanning shaft 14, the air 8 in the recording apparatus moves relative to the recording head, whereby the air 8 flows along the surface of the recording head, thereby eliminating the heat, generated by the discharge portions 5, from the surface thereof and from the surface of the support member 4 across the flexible cable 3.

At the same time, a part of the air 8 flows into the duct entrance 9*a* as illustrated, then flows around the ink flow path 13 and flows out from the duct exit 9*b* at the opposite side of the casing 2. In this manner the air 8 flows along the rear side (casing side) of the support member 4 and the vicinity of the flow path 13, thereby eliminating the heat from the rear surface of the support member 4. Such heat dissipation also from the rear surface of the support member 4 allows far more efficient cooling than in the conventional technology. Also, as illustrated, the support member 4 is positioned substantially horizontally with respect to the moving direction of the recording head together with the carriage. Therefore the air 8 can flow smoothly with respect to the support member 4 and the discharge portions without causing significant random flow. Also, since the support member 4 is formed as a flat plate as illustrated and is positioned adjacent to the discharge portions 5, the heat of the discharge portions 5 can be efficiently transmitted to the support member 4 and the transmitted heat can be efficiently radiated to the air 8. Furthermore, since the support member 4 is in flat contact with the discharge portions 5 in the present embodiment, the heat generated in the discharge portions 5 can be speedily transmitted to the support member 4. Furthermore, as the support member is positioned substantially parallel to the moving direction of the recording head, the surface of the support member 4 can be efficiently exposed to the air whereby the support member 4 itself can be promptly cooled by the air 8. The air 8 does not cause unnecessary stagnation even in the reciprocating motion of the recording head, so that the configuration of the present embodiment is effective for heat diffusion. Also, the presence of the inclined portion at the entrance 9*a* of the duct 6 allows the flow speed of the entering air 8 to be increased, thereby improving the heat dissipating effect. Also, the presence of the inclined portion also at the exit 9*b* of the duct 6 minimizes the resistance when the air flows out. As the carriage executes reciprocating motion in the main scanning direction, the flow of the air 8 and the functions of the entrance 9*a* and the exit 9*b* of the duct 6 are inverted in the reverse motion of the carriage.

Also, since the inclined portions at the entrance and exit of the duct 6 are so formed that the cross section of the duct 6 becomes smaller upwards (inclined portions being formed upward toward the outside of the duct 6), the air heated by the support member 4 can easily escape upwards even when the recording head is stopped.

When the discharge portions 5 are heated to or higher than a predetermined temperature, the conventional method interrupts the image recording operation and stops the carriage until the discharge portions are cooled. In the present embodiment, however, since the configuration has highly efficient heat dissipation to the air, the image recording is interrupted but the carriage movement is continued. In this manner, the cooling of the discharge portions 5 can be accelerated and the recovery of the recording head can be achieved more promptly.

Also, in the case of moving the carriage only for the purpose of cooling, the landing accuracy of the ink droplets need not be considered. Consequently the scanning motion of the carriage can be made faster than in the image recording operation, thereby further enhancing the cooling effect. Since the cooling effect becomes higher as the flow of the air 8 in the duct 6 is faster, it is desirable to execute the scanning motion of the carriage with the maximum possible width so as to minimize the acceleration and deceleration.

Also, in case the carriage executes reciprocating motion in the main scanning direction but executes the image recording operation in only one direction, the cooling effect can be improved by increasing the moving speed of the carriage in the opposite direction.

In the present embodiment, the discharge portions 5 are fixed by adhesion to the support member at each ink flow path 11. The fixed discharge portions 5 communicate with the ink tanks 1 through the ink flow paths 11, 13 and the joint portions 12 and can receive ink supply from the ink tanks 1. The number of the discharge portions and the ink flow paths, and the mode of fixation of the discharge portions to the ink flow paths vary according to the design specifications. In an example shown in FIG. 2A, one ink flow path 11 is larger than the other, and three discharge portions 5 are fixed by adhesion to the larger ink flow path 11.

The flexible cable 3 transmits electrical signals from the control unit (not shown) in the main body of the recording apparatus to the discharge portions 5, and is so provided, at an end, as to cover the surface (where the discharge portions 5 are fixed) of the support member 4. The portion covering the surface of the support member 4 is provided with an aperture in order to enable fixation of the discharge portions 5 to the support member 4, and the electrical connection between the discharge portions 5 and the flexible cable 3 is executed in the portion of this aperture.

The recording head of the above-described configuration is mounted on the carriage (not shown) and executes reciprocating (scanning) motion along the guide shaft 14. The air flows in the duct 6 along with such motion and the air flow performs cooling of the rear surface of the support member 4.

In addition to the aforementioned cooling by the duct 6, the recording head of the recording apparatus of the present embodiment is capped at the discharge face side by a cap member 16 at a predetermined position of the recording head, and a cooling fan 15 (portion represented by broken lines in FIG. 1) in such position. The cooling fan 15 is so provided as to feed air into the duct 6, and the operation of the cooling fan 15 is controlled by the unrepresented control unit. Such mechanism allows air to be fed into the duct 6 by the cooling fan 15 in a state where the discharge face of the recording head is capped (as indicated by an arrow 8). Consequently, the discharge portions 5 are not dried out even if a strong air flow from the cooling fan 15 is directed to the recording head.

Figure 2B:
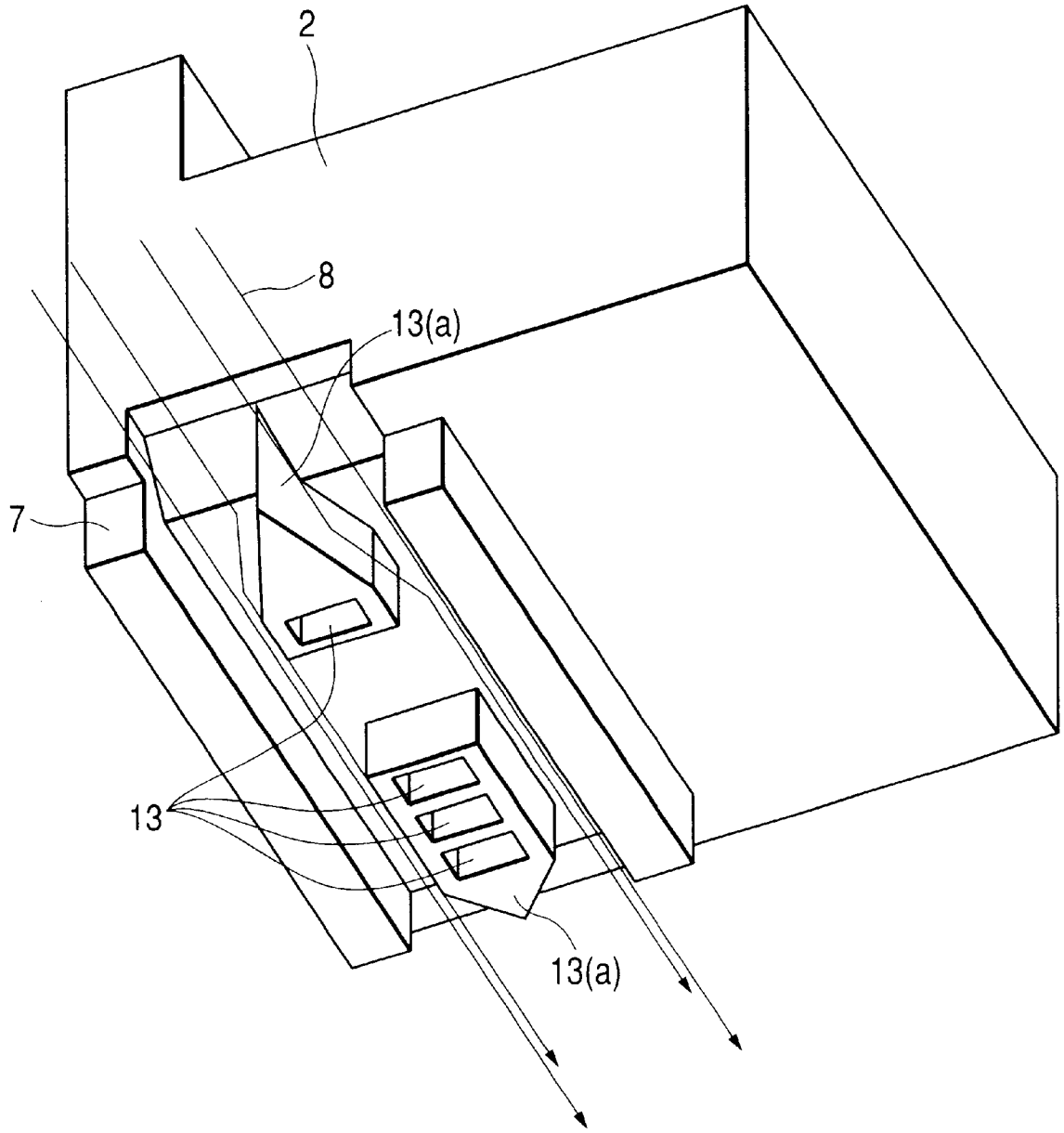
FIG. 2B is an exploded perspective view of another embodiment of the recording head shown in FIG. 2A.

In the following there will be explained, with reference to FIG. 2B, another configuration, which differs from the configuration shown in FIG. 2A in that an air rectifying portion 13*a* is provided at the duct entrance 9*a*.

In the present embodiment, an air rectifying portion 13*a* for guiding the air flow is provided, as illustrated, at the outside of the flow paths 13 in the main scanning direction, thereby stimulating smooth air flow without forming eddies at the walls of the flow paths 13 and minimizing the flow resistance of the air. It is effective to form the rectifying portion 13*a* in the front portion with respect to the head moving direction, corresponding to the reciprocating motion of the carriage.

In the present embodiment, the rectifying portion 13*a* is provided on the flow path 13, but the effect of the present invention can also be attained by providing the support portion 7 with a similar rectifying member.

In the foregoing embodiment, the support member 4 has been explained as having a flat plate shape, but the present invention is not limited to such configuration and a similar effect can also be obtained, for example, with an L-shaped support member.

In the following there will be explained the function of the recording apparatus of the present embodiment. As the entire configuration of the recording apparatus of the present embodiment is basically similar to the configuration shown in FIG. 14 except for the presence of the aforementioned air cooling mechanism, and the function is also similar except for the air cooling operation, there will not be explained the general recording operation and there will be explained an operation involving the air cooling.

Figure 3:
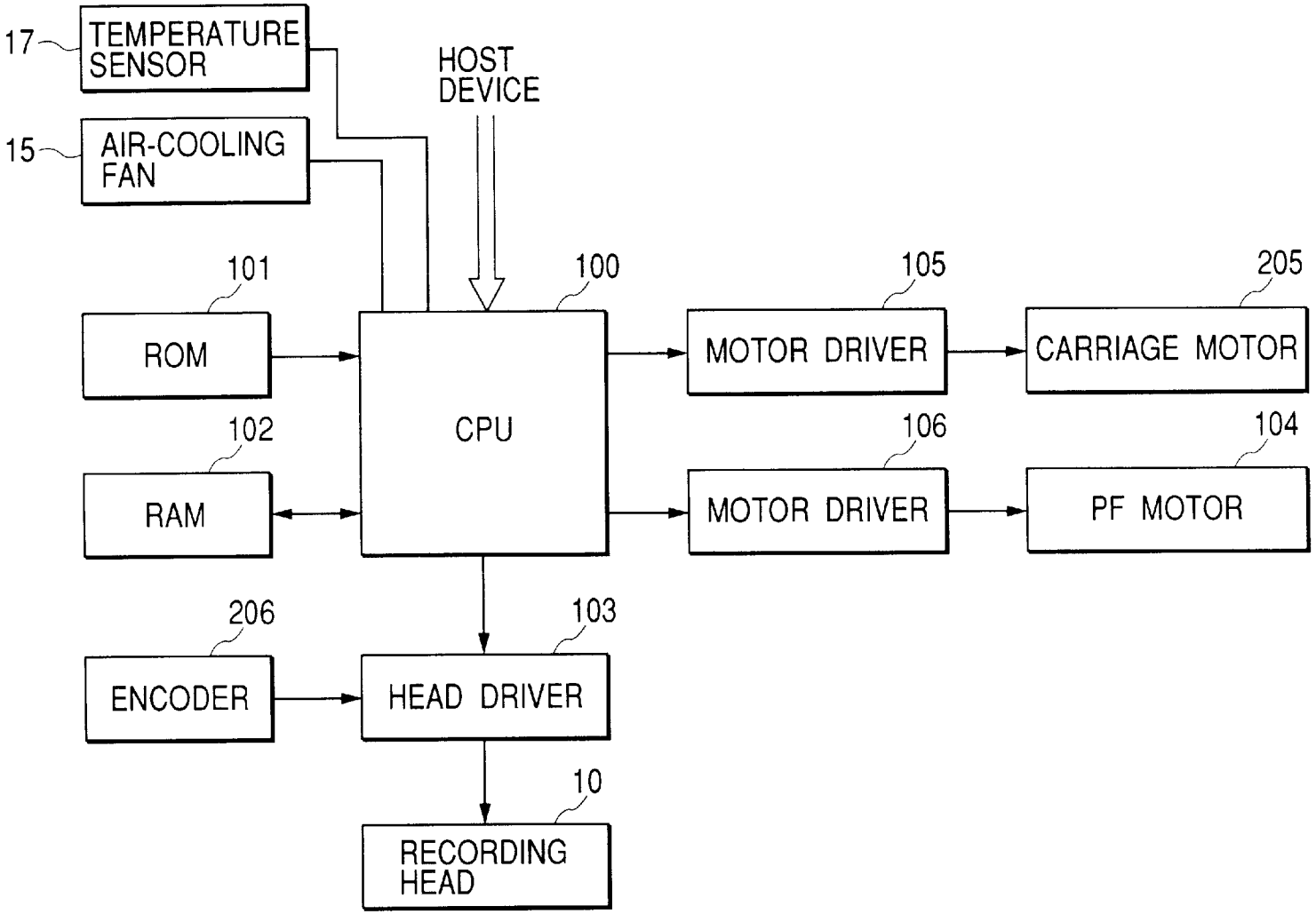
FIG. 3 is a block diagram showing a control system of the recording apparatus shown in FIG. 1.

FIG. 3 is a block diagram of a control system of the recording apparatus of the present embodiment, wherein a recording head 10 has the configuration shown in FIG. 1 and is provided, in a part thereof (preferably in the vicinity of the discharge portions constituting a heat generating part), with a temperature sensor 17. A ROM 101 stores a control program for the operation sequence including recording, air cooling operation for the recording head 10 and suction recovery operation thereof, and a RAM 102 is used as a work area in executing such operation sequence.

A CPU 100 executes, based on a control program stored in the ROM 101, processing of recording information received from a host apparatus utilizing peripheral units such as the RAM 102, thereby achieving, for example, conversion into recording data. Also, the CPU 100 outputs drive data for the electrothermal converting members of the discharge portions of the recording head 10, namely recording data and drive control signals, to a head driver 103. Furthermore, the CPU 100 controls a carriage driving motor 205 (cf. FIG. 14) for causing reciprocating motion of a carriage 200 (cf. FIG. 14) and a paper feeding (PF) motor 104 for conveying a recording paper P serving as the recording medium, respectively through motor drivers 105, 106. The head driver 103 receives a discharge timing signal and positional information of the carriage as drive data from an encoder 206 (cf. FIG. 14), and, based on the entered drive data, drives the electrothermal converting members of the recording head 10. In response, the recording head 10 discharges ink to achieve recording on the recording paper P.

Figure 4:
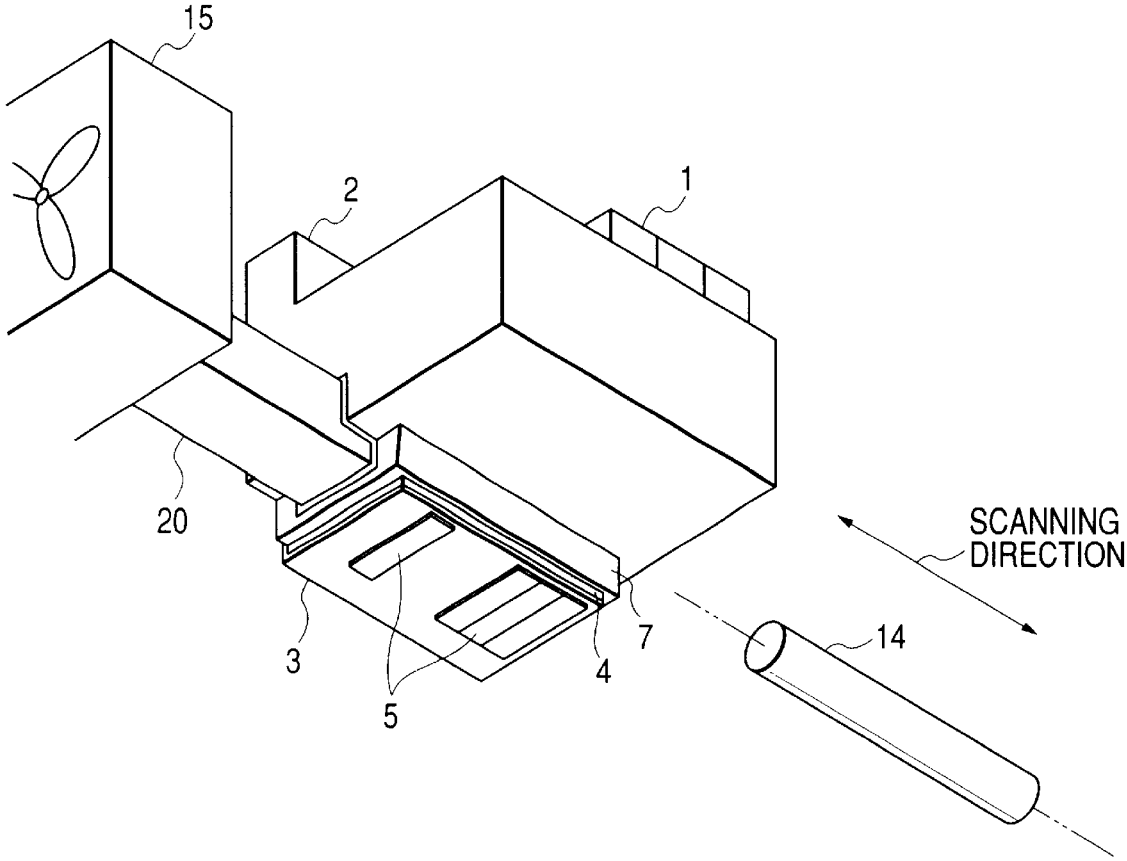
FIG. 4 is a view showing a recording head cooling mechanism for use in a recording apparatus, constituting a second embodiment of the present invention.

In case the temperature of the recording head 10, detected by the temperature sensor 17, exceeds a predetermined temperature (cooling start temperature) in the course of a recording operation, the CPU 100 interrupts the recording operation, moves the recording head 10 to a position above a capping member 16 and activates a cooling fan 15 (cf. FIG. 4). Thus, the air flows in the duct 6 of the recording head 10 to achieve air cooling thereof. When the temperature of the recording head 10, detected by the temperature sensor 17 becomes lower than a predetermined temperature (cooling end temperature), the CPU 100 restores the interrupted recording operation to start the recording by the recording head 10 again.

The air cooling operation mentioned above is a forced air cooling by the cooling fan 15. However, in the recording apparatus of the present embodiment, since the recording head 10 is provided with the duct 6 penetrating (extending) in a predetermined direction (scanning direction) and adjacent to the heat generating portion (discharge portions) in the head, the air flows in the duct 6 by the movement of the recording head 10 along the guide shaft 14, thereby cooling the head. Consequently, the forced air cooling operation by the cooling fan 15 is in practice required only in limited cases and may not be needed depending on the situation.

Also, the aforementioned forced air cooling by the cooling fan 15 may be combined with the conventionally known suction recovery operation.

Further, if it is required to rapidly cool the recording head 10, such requirement can be met by increasing the speed of the cooling fan 15 (increasing the amount of air).

Furthermore, the CPU 100 can also drive the cooling fan 15, in the course of recording operation by the recording head 10, with such an amount of air as not to affect the trajectory of the ink droplets discharged from the recording head 10. In such case, the air can be made to efficiently flow in the duct 6 of the recording head 10 by directing the air flow, generated by the cooling fan 15, along the scanning direction.

Also, since the recording apparatus contains therein heat sources such as the electric power supply, the temperature of the internal air is higher than that of the air outside the apparatus. Therefore, by providing the cooling fan so as to take in air from outside the apparatus, it is rendered possible to direct air of lower temperature to the recording head, thereby further enhancing the cooling effect. The intake of the external air is made possible for example by forming a slit or the like in the vicinity of the intake entrance of the cooling fan 15 in the outer casing of the recording apparatus.

In the recording apparatus of the present embodiment, the recording head can be cooled from the surface thereof and from the interior thereof owing to the presence of the duct 6 to achieve a higher cooling effect, so that the air amount can be reduced when the head is cooled by the cooling fan 15. It is therefore possible to drive the cooling fan 15 with such an amount of air as not to dry the discharge portions 5 and, in such case, the head face need not be covered by the cap member 16. Also, in such case, the position where the recording head is opposed to the cooling fan 15 can be other than the position of the cap member 16.

Also in the present embodiment, the duct 6 is provided in the scanning direction so as to efficiently cause the air flow therein with the movement of the head, but the present invention is not limited to such configuration and the penetrating (extending) direction of the duct 6 may be varied according to design factors such as the position and direction of the cooling fan 15. It is, however, preferable that the apertures of the duct are provided in the moving direction of the recording head (carriage) in the case of cooling with the air 8 by the movement of the recording head as explained in the foregoing.

Also in the present embodiment, the duct 6 is formed by a groove of a substantially square-U shaped cross section, but the present invention is not limited to such configuration and there may be adopted any configuration as long as an air flow can be formed along the exposed surface of the support member 4 in the duct 6.

In the recording apparatus for recording by ink discharge as in the present embodiment, there is usually provided a mist absorbing fan with a trapping filter at the sucking entrance in order to recover minute ink droplets (mist) that have not been deposited on the recording paper. Such mist absorbing fan is so constructed as to recover the mist with the trapping filter by an air flow from the interior to the exterior of the recording apparatus. It is also possible to cool the recording head with such mist absorbing fan instead of the aforementioned cooling fan 15. In such case, when the temperature of the recording head rises, the mist absorbing fan is driven in the reverse direction (for causing an air flow from the exterior of the recording apparatus to the interior), thereby directing air flow to a predetermined part of the recording head or introducing air into the duct 6.

Second Embodiment

Figure 5:
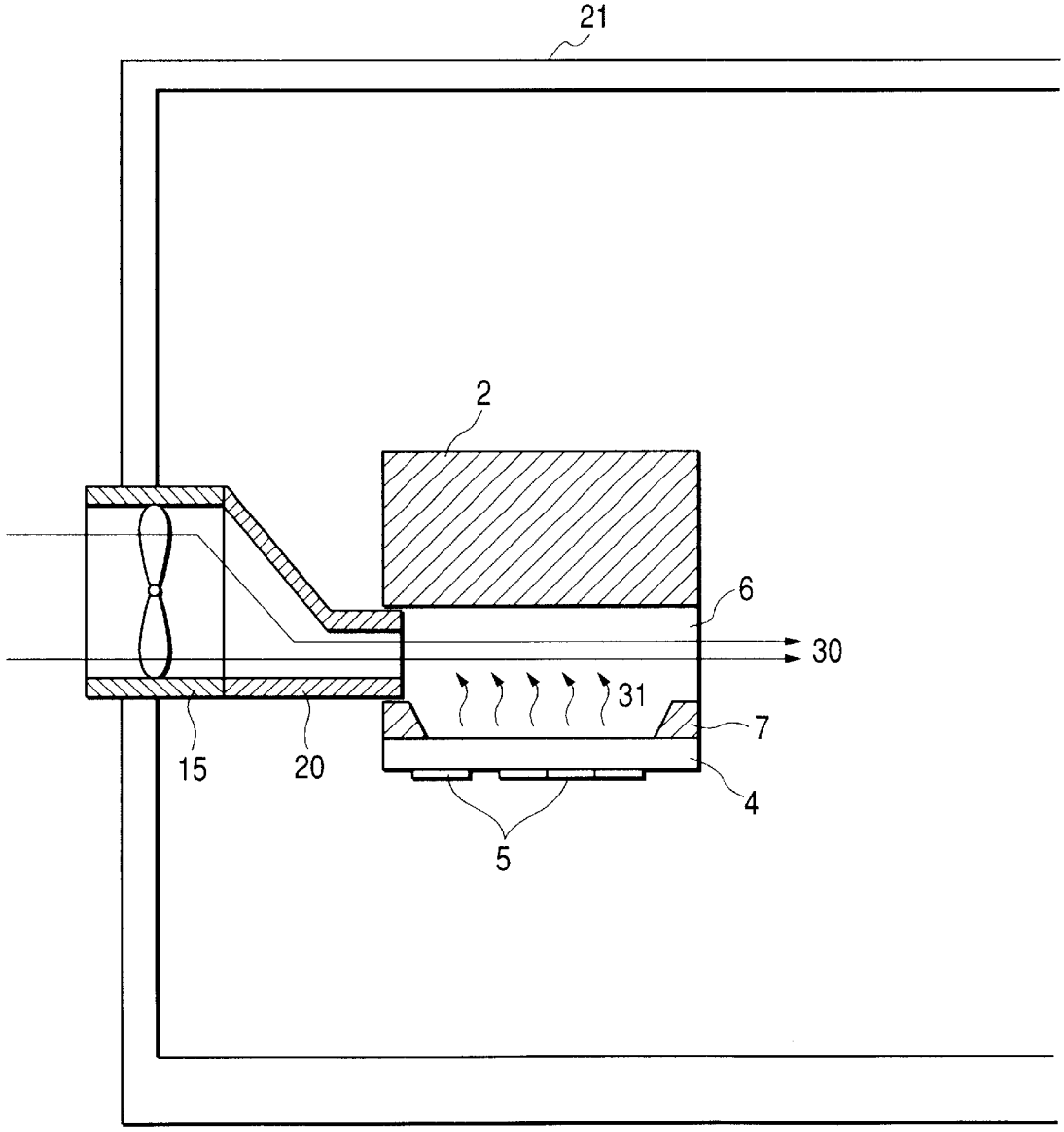
FIG. 5 is a lateral cross-sectional view showing the approximate configuration of a recording head cooling mechanism of the recording apparatus shown in FIG. 4.

FIG. 4 is a perspective view showing the recording head cooling mechanism of a recording apparatus constituting a second embodiment of the present invention, and FIG. 5 is a lateral cross-sectional view thereof. The cross-sectional view in FIG. 5 principally shows the connecting structure of a cooling fan 15, a connection duct 20 and a duct 6 but omits the detailed configuration of the recording head. In FIGS. 4 and 5, an arrow 30 indicates the air flow taken from the exterior by the cooling fan 15, and an arrow 31 indicates dissipation of the heat of the support member 4, heated by the temperature of the discharge portions 5, into the duct 6.

The recording apparatus of the present embodiment is different from that of the foregoing first embodiment in that the connection duct 20 is provided between the cooling fan 15 and the duct 6 of the recording head, thereby positively introducing the air into the duct 6. In the following there will be explained the features of the present embodiment, omitting the portions equivalent to those in the first embodiment.

The cooling fan 15 is provided on an outer casing 21 of the recording apparatus in such a manner as to introduce air from outside the recording apparatus into the interior. The exit of the cooling fan 15 is closely adjoined to an entrance end of the connection duct 20, whereby the air blown out from the cooling fan 15 flows into the connection duct 20.

An exit end of the connection duct 20 is so formed as to enter the duct entrance 9*a* of the duct 6 when the recording head is moved to a predetermined position. Thus the air blown out from the exit of the connection duct 20 securely flows into the duct 6 of the recording head. The connecting structure between the exit end of the connection duct 20 and the entrance 9*a* of the duct 6 is not limited to that shown in FIGS. 4 and 5 but there may be adopted any configuration as long as the air flow blown out from the exit of the connection duct 20 securely flows into the duct 6 of the recording head. For example, the connection duct 20 may have a sharply bent structure.

The recording apparatus of the present embodiment in which the cooling fan 15 and the duct 6 of the recording head are connected by the connection duct 20 as explained in the foregoing has the following three features:

(1) Faster Flow Speed

The cross sectional area of the exit of the cooling fan 15 is larger than that of the entrance 9*a* of the duct 6 of the recording head. In such case, the connection duct 20 assumes a structure in which the cross section of the entrance is larger than that of the exit, namely a structure pointed toward the exit. Such structure allows all the air flow, generated by the cooling fan 15, to be channeled into the duct 6 of the recording head, thereby increasing the air flow speed in the duct 6 and enhancing the air cooling effect.

(2) Less Susceptible to the Influence of Heat Generated in Other Parts of the Apparatus The cooling fan 15 is so constructed as to take in air from outside the apparatus into the interior and to introduce the outside air directly into the duct 6 of the recording head through the connection duct 20 without causing the outside air to be mixed with the air heated by the heat from other parts inside the apparatus. Consequently, the air cooling effect for the recording head can be maintained even when the temperature inside the recording apparatus becomes high.

(3) Capping for Preventing Drying is Unnecessary

Since the air taken into by the cooling fan 15 directly flows into the duct 6 of the recording head through the connection duct 20, the discharge portions 5 are not dried by the air flow generated by the cooling fan 15. In the present embodiment, therefore, it is not necessary, in the forced air cooling operation, to move the recording head to the position of the cap member 16 and to cap the discharge portions of the recording head as in the foregoing first embodiment, but the cooling fan 15 can be provided in a position different from that of the recording mechanism. For example, the cooling fan 15 may be provided, within the moving range of the recording head, in a position opposite to that of the recovery mechanism. Since the recovery mechanism is generally complex in structure, it is usually difficult to provide the cooling fan in the position of such mechanism, so that the cooling fan 15 is advantageously positioned opposite to the position of the recovery mechanism and such positioning is also advantageous for making the recording apparatus compact.

The forced air cooling operation utilizing the cooling fan 15 in the present embodiment is also executed by the control system (cf. FIG. 3) explained in the foregoing first embodiment. In case the temperature of the recording head 10, detected by the temperature sensor 17, exceeds a predetermined temperature (cooling start temperature) in the course of a recording operation, the CPU 100 interrupts the recording operation, moves the recording head 10 to a predetermined position and activates the cooling fan 15. Thus, the external air is drawn in by the cooling fan 15 and the drawn in air flows into the duct 6 of the recording head 10 through the connection duct 20, thereby cooling the head. When the temperature of the recording head 10, detected by the temperature sensor 17, becomes lower than a predetermined temperature (cooling end temperature), the CPU 100 restores the interrupted recording operation to start recording by the recording head 10 again.

In the following there will be explained a specific structural example of the recording head, having a cooling duct therein, applicable to the recording apparatus of the first and second embodiments.

First Structural Example of Recording Head with Duct

Figure 6B:
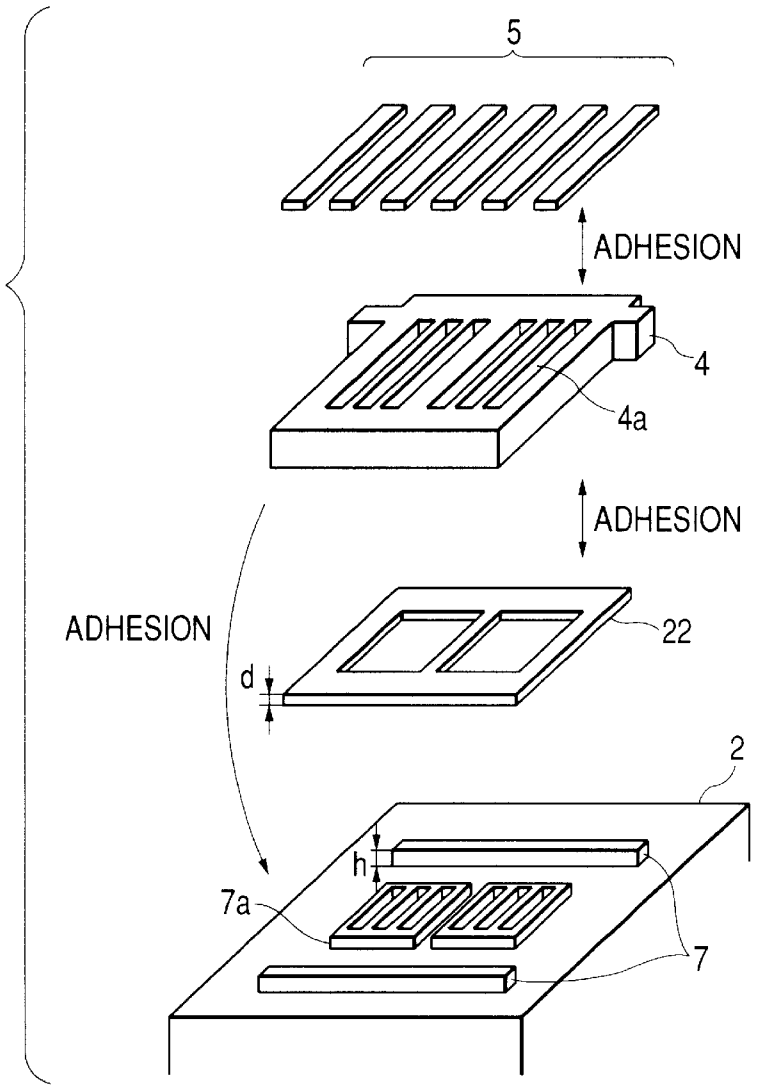
FIGS. 6A and 6B are respectively a perspective view and an exploded perspective view showing a first structural example of a recording head with a duct applicable to the recording apparatus of the present invention.
Figure 6A:
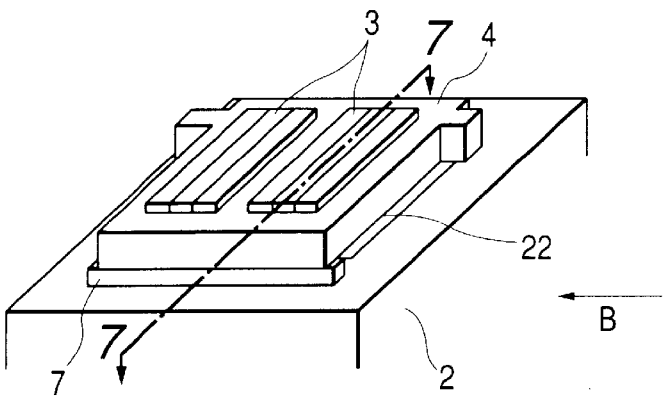

FIGS. 6A and 6B show a first structural example of the recording head with a duct applicable to the recording apparatus of the present invention, and are respectively a perspective view and an exploded perspective view of discharge portions.

A support member 4 is provided with plural ink flow paths 4*a*, and discharge portions 5 are fixed by adhesion on the ink flow paths 4*a*, respectively, while a heat accumulating plate 22 of satisfactory thermal conductivity is fixed by adhesion to the rear surface of support member 4 (i.e., on the surface opposite to the surface on which the discharge portions 5 are adhered). An ink supply portion 7 is composed of a molded member (for example, of organic resinous material) and is provided with plural ink flow paths 7*a* respectively corresponding to the ink flow paths 4*a* of the support member 4, and the support member 4 is fixed by adhesion in such a manner that the corresponding ink flow paths are mutually connected. The adhesion between the discharge portions 5 and the support member 4, between the support member 4 and the heat accumulating plate 22, and between the support member 4 and the ink supply portion 7, is achieved by an adhesive material of very high thermal conductivity. The ink supply portion 7 is provided, in a portion thereof excluding the ink flow paths 7*a*, with a substantially square-U shaped cross section constituting a groove portion continuous in a direction, and, when the support member 4 is fixed to the ink supply portion 7, such groove portion constitutes a duct 6 penetrating (extending) in a predetermined direction.

The configuration described above is similar to that of the recording head shown in FIG. 2, except for the presence of the heat accumulating plate 22.

Figure 7:
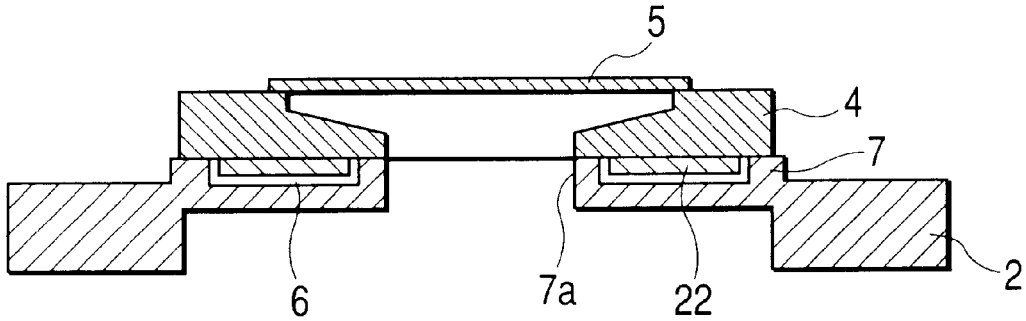
FIG. 7 is a cross-sectional view along a line 7—7 in the discharge portion shown in FIG. 6A.

The heat accumulating plate 22 is provided with an aperture in a position corresponding to the portion of the ink flow paths 7*a* and has a thickness d which is sufficiently smaller than the height h from the rear surface of the head casing 2 in a portion of the ink supply portion 7 where the support member 4 is fixed. FIG. 7 is a cross-sectional view of the discharge portion along a line 7—7 shown in FIG. 6A and seen from a direction B. As will be apparent from FIG.

7, the heat accumulating plate 22 is fixed by adhesion in such a manner as to substantially cover the rear surface, excluding the ink flow paths 4*a*, of the support member 4 exposed in the duct 6, but does not close the duct 6.

In the present recording head, the heat generated in the discharge portions 5 at ink discharge is promptly transmitted by solid heat conduction to the support member 4 and the heat accumulating plate 22, and, in comparison with a recording head without the heat accumulating plate 22 (for example, that shown in FIG. 2), the heat capacity is made larger by the presence of the heat accumulating plate 22. Therefore the recording head of the present embodiment is capable of accumulating a large amount of heat generated during the ink discharging operation and shows less temperature rise in comparison with the recording head without the heat accumulating plate 22 (for example, that shown in FIG. 2). Consequently, the present recording head is capable, for example, in a continuous recording operation, of preventing the head from being destroyed within a short time by the heat generated in the discharge portions 5 and also of stable recording over a prolonged period without interruption of the recording operation for the purpose of cooling. The aforementioned forced air cooling operation utilizing the cooling fan is executed if the recording operation becomes unstable because of the temperature rise, but the frequency of execution of such operation can be reduced in comparison with the case of the recording head shown in FIG. 2, because of the larger heat capacity of the head of the present invention. Also, the present invention is not limited to the abovedescribed configuration but the aforementioned effects can be attained also in a configuration having a support member between the heat accumulating plate 22 and the casing 2.

Members coming into contact with the ink can be composed only from a limited range of materials that neither deteriorate in ink nor deteriorate ink, but the heat accumulating plate 22, not constituting the ink flow path, can be composed of any material.

Consequently, the heat accumulating plate 22 can be composed of a material of excellent thermal conductivity such as aluminum, alumina or copper, thereby enhancing the cooling effect.

Also, the heat accumulating plate 22 is advantageous in cost, as it has a simple flat structure in the top and rear surfaces and does not require complex working.

The cooling can be achieved by heat dissipation from the rear surface of the heat accumulating plate 22 and by contact of the rear surface with the air flowing in the duct 6. The cooling effect can be enhanced by enlarging the area of the heat dissipating surface and the cooling surface of the heat accumulating plate 22.

In the following there will be explained an example of the heat accumulating plate that can enlarge the area of the heat dissipating surface and the cooling surface.

Figure 8A:
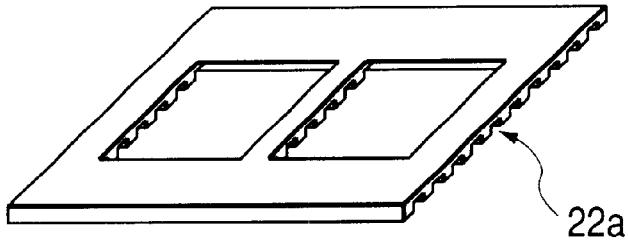
FIGS. 8A, 8B and 8C are perspective views showing variations of a heat accumulating plate shown in FIG. 7.
Figure 8B:
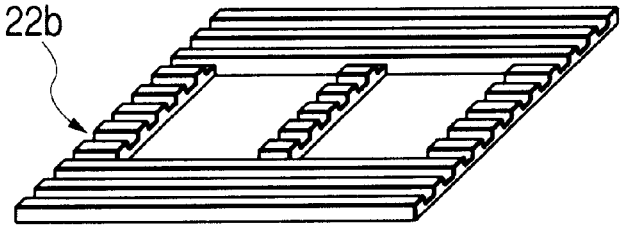
Figure 8C:
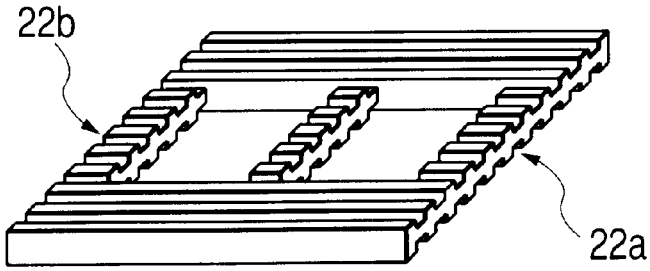

FIGS. 8A to 8C show variations of the heat accumulating plate 22 shown in FIG. 7. The heat accumulating plate shown in FIG. 8A is provided, on a surface opposite to that fixed to the support member 4, with plural grooves 22*a*, which are formed along the scanning direction (main scanning direction of the carriage) to generate air flow by the carriage movement, thereby enhancing the cooling effect. Also the presence of such grooves 22*a* increases the area of the heat dissipating surface, thereby also enhancing the cooling effect. Such configuration is capable of radiating the heat generated in the discharge portions 5 more efficiently than in the configuration shown in FIG. 7.

The heat accumulating plate shown in FIG. 8B is provided, on a surface fixed to the support member 4, with plural grooves 22*b*, which are also formed along the scanning direction to generate air flow by the carriage movement, thereby enhancing the cooling effect. Also the presence of such grooves 22*b* increases the area of the heat dissipating surface (in this case the sum of the area of the rear surface of the heat accumulating plate exposed in the duct 6 and the surface area of the grooves 22*b*), thereby also enhancing the cooling effect. Such configuration is also capable of radiating the heat generated in the discharge portions 5 more efficiently than in the configuration shown in FIG. 7.

The heat accumulating plate shown in FIG. 8C is provided with both the grooves 22*a* shown in FIG. 8A and the grooves 22*b* shown in FIG. 8B. Such configuration can further enhance the cooling effect in comparison with the configurations shown in FIGS. 8A and 8B.

In the heat accumulating plates shown in FIGS. 8A to 8C, the shape of the grooves 22*a*, 22*b* are not limited to the illustrated ones but can be arbitrarily long, so as to effectively increase the surface area of the heat dissipating portion. The configurations shown in FIGS. 8A to 8C do not cause a decrease in strength, and do not hinder the securing of the adhesion area for stable adhesion with the heat accumulating plate, the convenience of the operations such as adhesion or assembling, or obtaining a volume capable of sufficiently dissipating the heat generated in the discharge portions. Also, plural holes may be employed instead of the grooves. In such case, such holes are preferably formed in the scanning direction. Furthermore, the aforementioned grooves and holes may be employed in combination.

Second Structural Example of Recording Head with Duct

In the foregoing first structural example of the recording head with a duct, the external wall of the ink flow paths exposed in the duct is formed collectively for a certain number of the ink flow paths. In the following there will be explained a structure in which the external wall of each ink flow path is exposed in the duct.

Figure 9B:
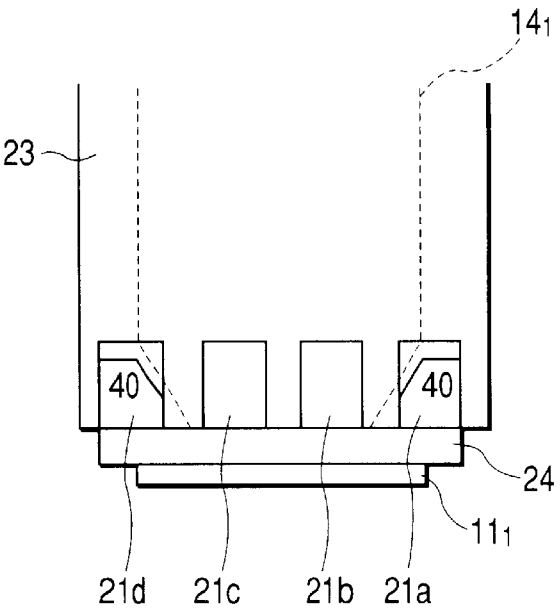
FIGS. 9A and 9B are respectively a plan view and a lateral view showing a second structural example of a recording head with a duct applicable to the recording apparatus of the present invention.
Figure 9A:
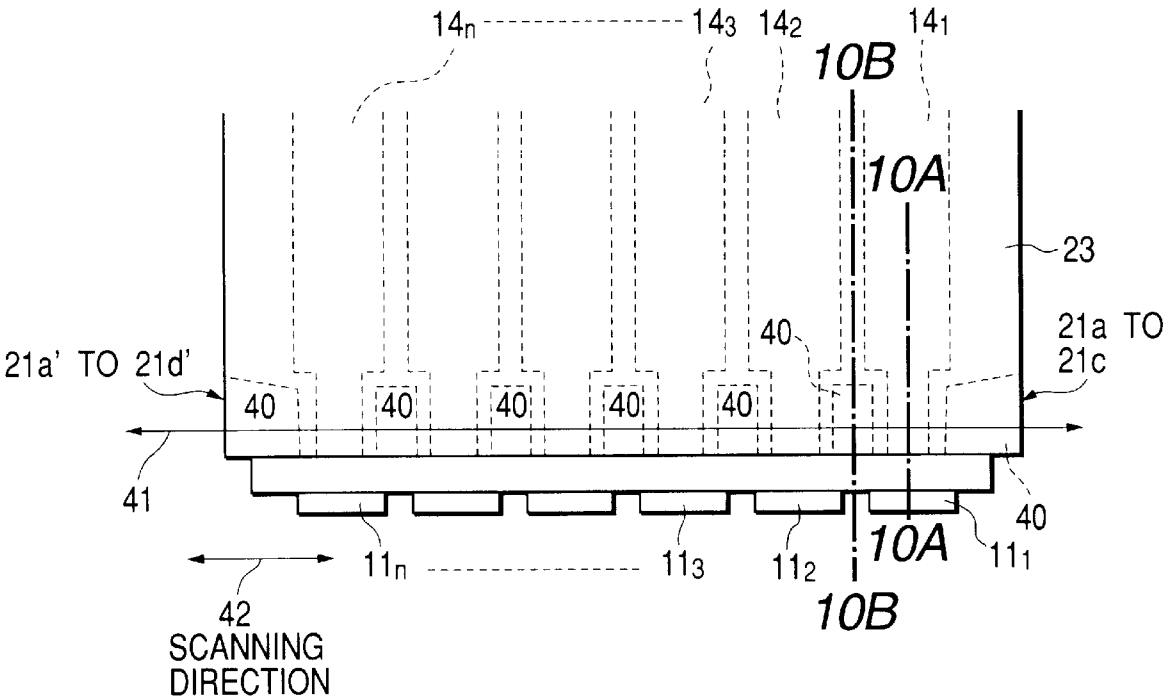

FIGS. 9A and 9B show a second structural example of the recording head with a duct applicable to the recording apparatus of the present invention, and are respectively a plan view and a lateral view of discharge portions.

Plural silicon chips $\mathbf{11}_1$ to $\mathbf{11}_n$ constituting the discharge portions are fixed to a chip plate 24, which is in turn fixed to an ink supply portion 23. Each of the silicon chips $\mathbf{11}_1$ to $\mathbf{11}_n$ is provided with plural discharge ports along the longitudinal direction (perpendicular to the scanning direction), and the ink supply portion 23 is provided with plural ink flow paths $\mathbf{14}_1$ to $\mathbf{14}_n$ respectively corresponding to the silicon chips $\mathbf{11}_1$ to $\mathbf{11}_n$. Each of the silicon chips $\mathbf{11}_1$ to $\mathbf{11}_n$ is provided with energy conversion elements such as electrothermal converting elements respectively corresponding to the discharge ports, and such energy conversion elements provide the ink with discharge energy (thermal energy generated by film boiling), thereby discharging the ink as ink droplets from the discharge ports.

The chip plate 24 has to be formed exactly flat and is therefore often prepared with a ceramic material such as alumina.

The ink supply portion 23 is usually formed from an organic resinous material as it includes the ink flow paths of complex shape.

In FIGS. 9A and 9B, an arrow 42 indicates the scanning direction of the recording head, along which the silicon chips $11_1$ to $11_n$ are arranged. At the side of a surface of the ink supply portion 23 where the chip plate 24 is to be provided, there is provided a duct 40 penetrating (extending) along the scanning direction (indicated by the arrow 42).

At a lateral face of the ink supply portion 23 where the chip plate 24 is provided, there are formed apertures 21*a* to 21*d*. Similarly, at the other lateral face of the ink supply portion 23 there are formed apertures 21*a*' to 21*d*'. When the recording head moves in the direction 42, the air flows in the duct 40 through these apertures 21*a* to 21*d*, 21*a*' to 21*d*'. An arrow 41 indicates such air flow.

Figure 10B:
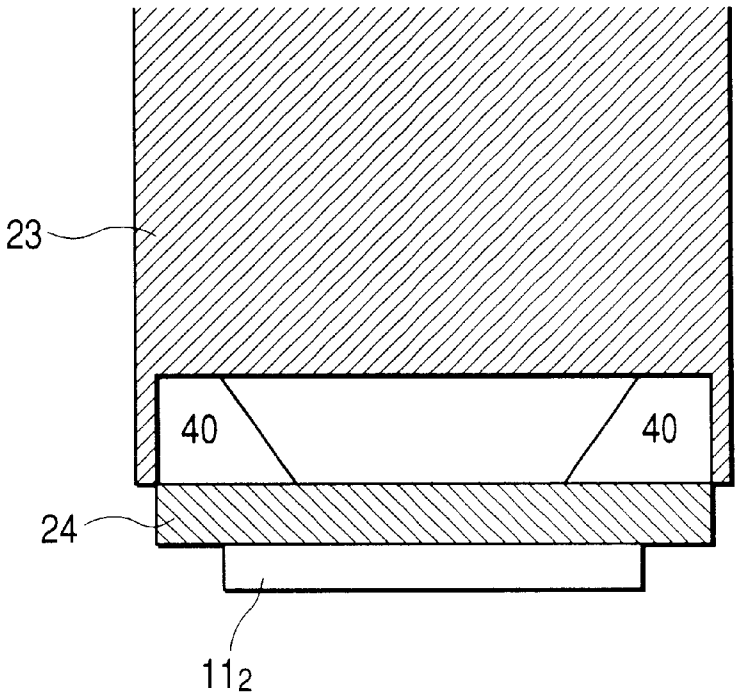
FIGS. 10A and 10B are cross-sectional views respectively along a line 10A—10A and a line 10B—10B in FIG. 9A.
Figure 10A:
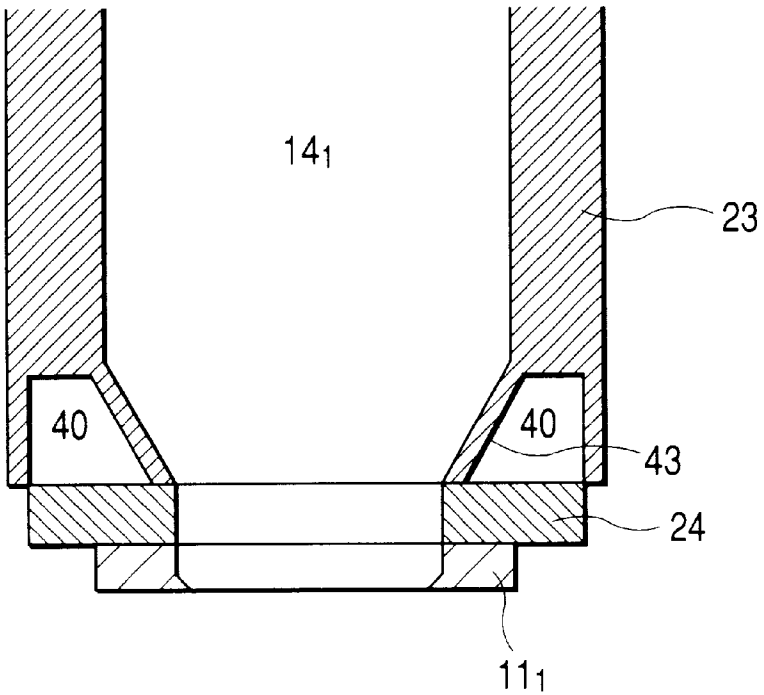

FIGS. 10A and 10B show the cross-sectional structure of the duct 40 shown in FIGS. 9A and 9B and are respectively cross-sectional views along a line 10A—10A and a line 10B—10B in FIG. 9A. The duct 40 constitutes the wall of the flow path in a part of the rear surface of the chip plate 24 (opposite to the surface on which the silicon chips are provided), and penetrates (extends) in the longitudinal direction of the chip plate 24 along the rear surface thereof. In the duct 40 there are present the external walls of the ink flow paths $14_1$ to $14_n$ (FIG. 10A showing the external wall 43 of the flow path $14_1$), and the air flowing in the duct 40 flows in a part thereof so as to surround such external walls and flows as a whole along the rear surface of the chip plate 24 in the longitudinal direction thereof (as indicated by an arrow 41 in FIG. 9A). In such configuration, all the rear surface of the chip plate is cooled by the air flow, except for the joining portion of the ink flow paths. Such duct 40 can be formed for example by injection molding.

When the recording head of the aforementioned configuration moves in the direction of the face having the apertures 21*a* to 21*d* in the scanning motion, the air flows in the duct 40 through the apertures 21*a* to 21*d* and flows out from the apertures 21*a*' to 21*d*' at the opposite side. On the other hand, in a scanning motion in the direction of the face having the apertures 21*a*' to 21*d*', the air flows in the apertures 21*a*' to 21*d*' and flows out from the apertures 21*a* to 21*d*. As a result, an air flow as indicated by an arrow 41 is generated in the duct 40 in the head by the movement of the recording head, which cools the rear surface of the chip plate 24.

In the scanning (recording) operation, the temperature rises in the vicinity of the silicon chips $11_1$ to $11_n$ provided with the heat generating portions (vicinity of the ink discharge ports), but the present recording head can prevent excessive temperature rise in the vicinity of the silicon chips $11_1$ to $11_n$ since the chip plate 24 is cooled as explained in the foregoing. More specifically, in the present recording head, not only the surface of the silicon chips 11 constituting the heat sources but also the rear surface of the chip plate 24 are air cooled by the scanning motion, whereby the temperature rise of the recording head can be more effectively suppressed.

In the present recording head, the duct 40 is preferably so formed as to maximize the area of the rear surface of the chip plate 24 exposed in the duct, while not hindering the ink flow paths $14_1$ to $14_n$ and leaving a space for sufficient fixation of the chip plate 24 to the ink supply portion 23. Such configuration allows for further enhancement of the cooling effect. Since the chip plate 24 has to be exactly flat, the duct 40 is so formed as not to damage the flatness of the chip plate 24.

The duct 40 may be provided in any position as long as the cooling effect can be obtained, but is preferably provided in the vicinity of the discharge portions constituting the heat sources. In the configuration shown in FIGS. 9A and 9B, since the chip plate 24 tends to be heated, as it is fixed to the silicon chips 11 having the heat sources, the duct 40 is most preferably provided on the rear surface of the chip plate 24.

In the above-mentioned case, the cooling effect can be further enhanced by enlarging the area of the rear surface of the chip plate 24, exposed to the air flow in the duct 40. In order to increase the area exposed to the air, the rear surface of the chip plate 24 may be formed as an irregular surface. In such case, such irregular surface is preferably formed in a pattern not hindering the air flow in the duct 40, for example, a pattern having grooves in the direction of the air flow. However, since the chip plate 24 has to be exactly flat, the irregular pattern is so formed as not to damage the flatness of the chip plate 24.

Figure 11B:
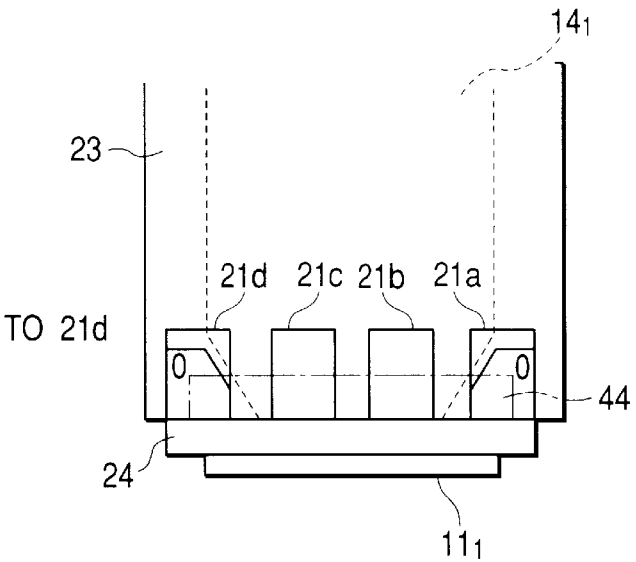
FIGS. 11A and 11B are respectively a plan view and a lateral view showing a configuration provided with a heat accumulating plate in the recording head shown in FIGS. 9A and 9B.
Figure 11A:
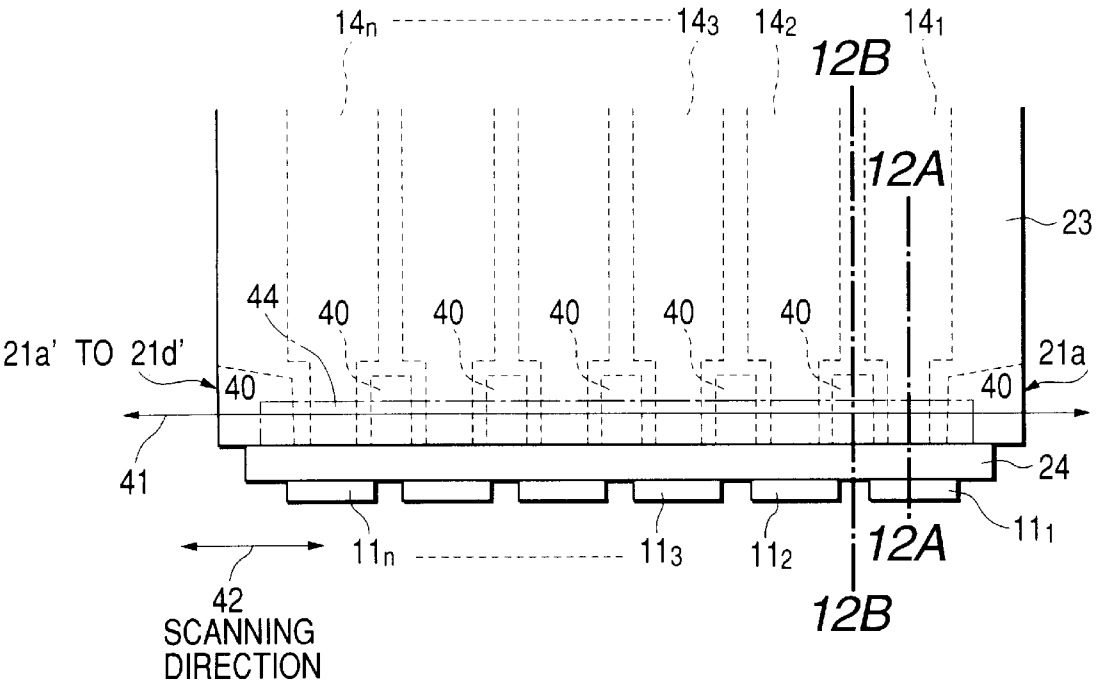

As in the foregoing first structural example of the recording head with a duct, it is effective, also in the present recording head, to provide the heat accumulating plate on the rear surface of the chip plate 24. FIGS. 11A and 11B are respectively a plan view and a lateral view showing an example of providing the recording head shown in FIGS. 9A and 9B with a heat accumulating plate.

This recording head is provided, in addition to the configuration of the aforementioned recording head shown in FIGS. 9A and 9B, with a heat accumulating plate 44 composed of a member of high thermal conductivity, such as of aluminum, as a heat diffusion means for diffusing the heat generated by the silicon chips. In FIGS. 11A and 11B, components equivalent to those in FIGS. 9A and 9B are represented by like numbers and will not be explained further.

Figure 12B:
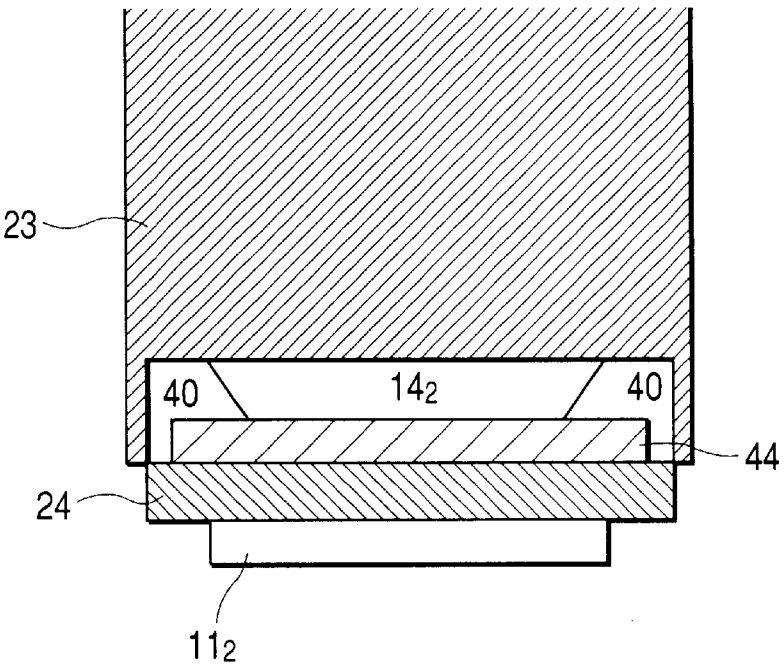
FIGS. 12A and 12B are cross-sectional views respectively along a line 12A—12A and a line 12B—12B in FIG. 11A.
Figure 12A:
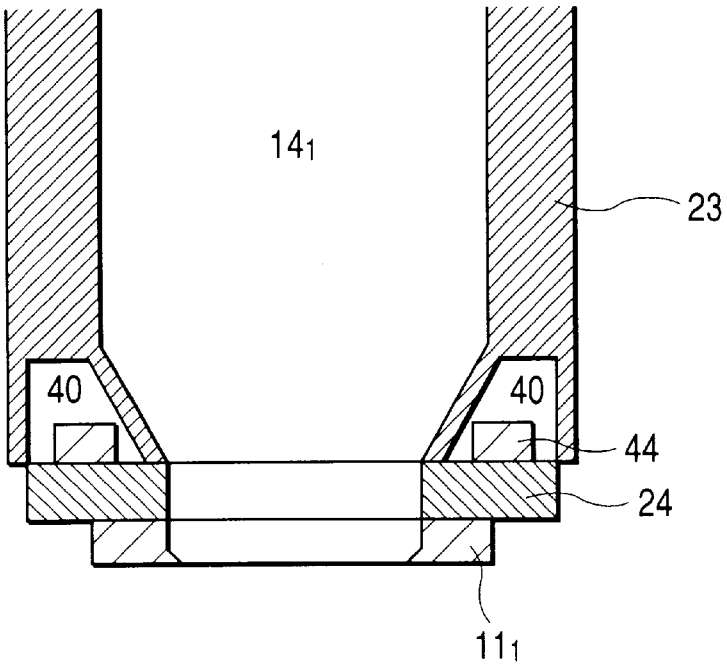

The heat accumulating plate 44 is provided in the duct 40. FIGS. 12A and 12B are cross-sectional views respectively along a line 12A—12A and a line 12B—12B in FIG. 11A. As shown in FIGS. 12A and 12B, the heat accumulating plate 44 is provided with an aperture in the portion of the ink flow paths $14_1$ to $14_n$ so as not to hinder these flow paths, and is fixed by adhesion so as to cover the rear surface of the chip plate 24 exposed in the duct 40.

Because of the incorporation of the heat accumulating plate 44, the heat accumulated in the chip plate 24 diffuses at first to the heat accumulating plate 44. Then, by the movement of the recording head in the scanning direction, the air flows into the duct 40 and the heat accumulating plate 44 is air cooled by the air flow.

The cooling effect of the heat accumulating plate 44 can be increased by enlarging the area thereof exposed to the air flow in the duct 40. Consequently the heat accumulating plate 44 is preferably so formed, as shown in FIGS. 12A and 12B, as to cover all the rear surface of the chip plate 24 excluding the ink flow paths.

The heat accumulating plate 44 may have an irregular shape in order to increase the area exposed to the air. In such case, such irregular shape is preferably formed in a pattern not hindering the air flow in the duct 40, for example, a pattern having grooves in the direction of the air flow.

Third Embodiment

The recording apparatus of the present embodiment is provided, in addition to the configuration of the foregoing first or second embodiment, with a heat transporting device, such as a heat pipe, for transporting the heat generated in the discharge portions constituting the heat generating portions, from the interior of the head to the exterior thereof, and a heat dissipating portion for radiating the heat transported by the heat transporting device.

The heat transporting device is so provided that an end thereof (heat absorbing end) is in contact with the rear surface (opposite to the surface on which the discharge portions are fixed) of the support member. The heat dissipating portion is so provided as to be in contact with the other end (heat dissipating end) of the heat transporting device. The surface of the heat dissipating portion may be exposed to the air flow from the cooling fan. The heat dissipating portion is composed of a material with excellent heat conductivity, such as aluminum, alumina or copper.

The heat generated in the discharge portions is immediately transmitted to the support member and then through the heat transporting device to the heat dissipating portion. The surface of the heat dissipating portion is in contact with the air from outside the head, so that the heat transmitted to the heat dissipating portion is radiated to the air from outside the head. The heat dissipating portion also serves, like the aforementioned heat accumulating plate, as a member for increasing the heat capacity.

The forced air cooling operation utilizing the cooling fan 15 in the present embodiment is also executed by the control system (cf. FIG. 3) explained in the foregoing first embodiment. In case the temperature of the recording head 10, detected by the temperature sensor 17, exceeds a predetermined temperature (cooling start temperature) in the course of a recording operation, the CPU 100 interrupts the recording operation, moves the recording head 10 to a predetermined position and activates the cooling fan 15. Thus the air flow from the cooling fan 15 is directed to the heat dissipating portion of the recording head, thereby cooling the head. When the temperature of the recording head 10, detected by the temperature sensor 17, becomes lower than a predetermined temperature (cooling end temperature), the CPU 100 restores the interrupted recording operation to start recording by the recording head 10 again.

Carriage

In the case of mounting the aforementioned recording head with a duct on a carriage, it may be necessary to provide the carriage with an entrance and an exit for inducing the air flow in the duct, depending on the configuration of the carriage. In the following there will be explained the configuration of such carriage.

Figure 13:
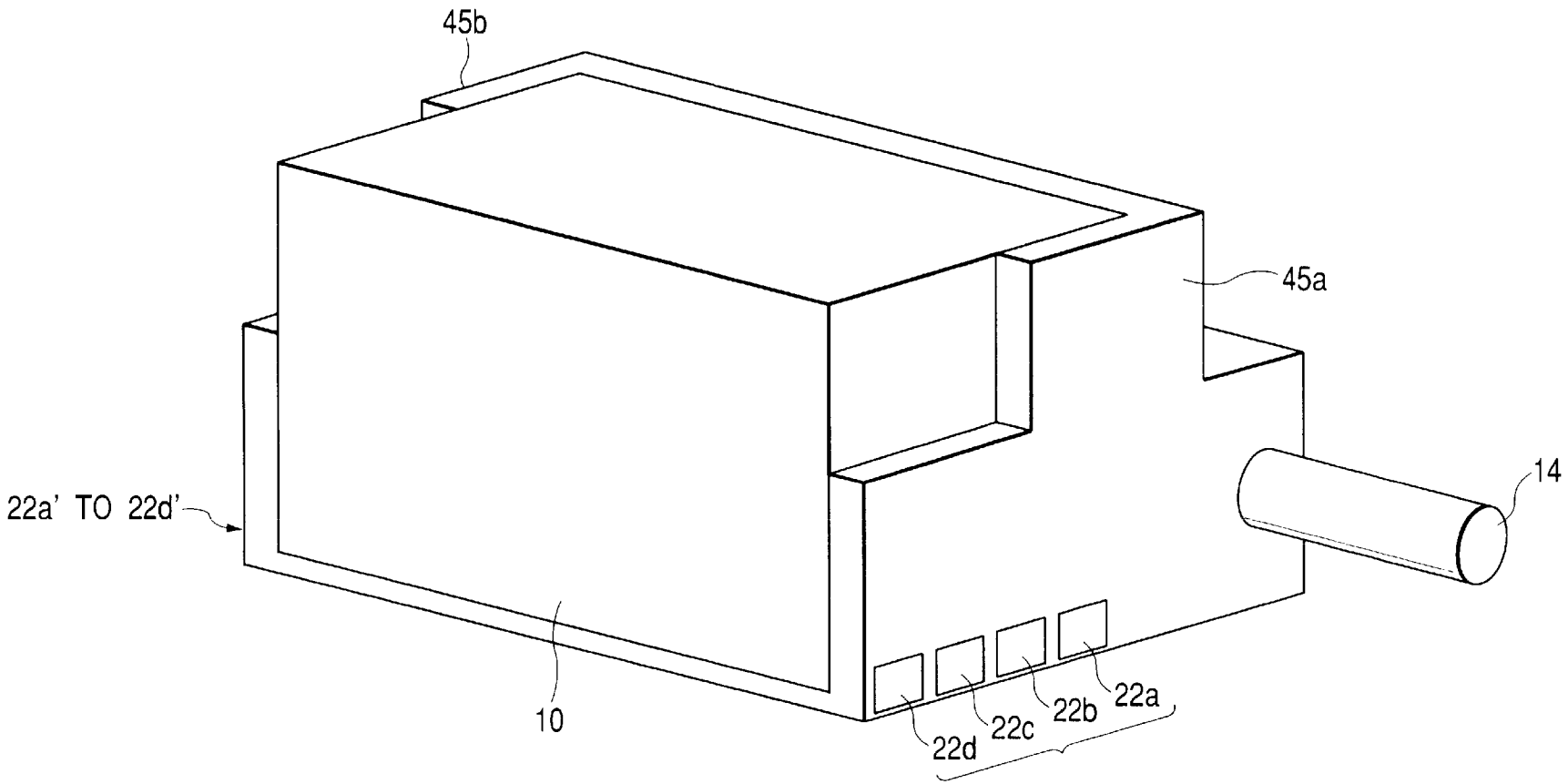
FIG. 13 is a perspective view showing an example of a carriage for supporting a recording head with a duct applicable to the recording apparatus of the present invention.

FIG. 13 is a perspective view showing an example of the carriage for mounting the recording head with a duct, applicable to the recording apparatus of the present invention. This carriage is capable of supporting the recording head 10 of the configuration shown in FIGS. 9A to 12B, and is movable along the guide shaft 14. The carriage is provided with two mutually opposed lateral faces 45*a*, 45*b* to be in contact with the faces, having the entrance/exit of the duct, of the recording head 10. A lateral face 45*a* is provided with apertures 22*a* to 22*d* while the other lateral face 45*b* is provided with apertures 22*a*' to 22*d*'. The apertures 22*a* to 22*d* respectively correspond to the apertures 21*a* to 21*d* of the recording head 10, while the apertures 22*a*' to 22*d*' respectively correspond to the apertures 21*a*' to 21*d*' of the recording head 10.

When the carriage moves toward the side of the lateral face 45*a* along the guide shaft 14, the air flows into the apertures 22*a* to 22*d* of the lateral face 45*a* and then into the duct 40 in the recording head through the apertures 21*a* to 21*d* thereof. The air entering the interior of the duct 40 flows out, through the apertures 21*a*' to 21*d*' of the recording head 10, from the apertures 22*a*' to 22*d*' of the lateral face 45*b* of the carriage.

On the other hand, when the carriage moves toward the side of the lateral face 45*b* along the guide shaft 14, the air flows into the apertures 22*a*' to 22*d*' of the lateral face 45*b* and then into the duct 40 in the recording head through the apertures 21*a*' to 21*d*' thereof. The air entering the interior of the duct 40 flows out, through the apertures 21*a* to 21*d* of the recording head 10, from the apertures 22*a* to 22*d* of the lateral face 45*a* of the carriage.

In the case of cooling the recording head with the cooling fan shown in FIGS. 1 and 4, the air from the cooling fan is introduced into the apertures 22*a* to 22*d* on the lateral face 45*a* of the carriage or the apertures 22*a*' to 22*d*' in the lateral face 45*b* of the carriage.

In the recording apparatus of the foregoing first to third embodiments, the cooling mechanism for the recording head has been explained for an ink jet recording head in which the discharge portions (silicon chips) are fixed to the support member (chip plate), which is in turn fixed to the ink supply portion, but the present invention is not limited to such configuration and is likewise applicable to recording heads of other configurations.

Other Embodiments

The cooling mechanism for the recording apparatus of the foregoing first to third embodiments is applicable also to a recording apparatus provided with a recording head of a thermal type. In such case, the control system can be substantially the same as that shown in FIG. 3 except that a recording operation with a thermal head is executed instead of the recording operation with ink, and the air cooling operation with the cooling fan is executed by the CPU based on the temperature detected by a temperature sensor mounted on the recording head. However, in the case of thermal recording, since ink is not used, it is not necessary to consider the aberrations in the landing positions of the ink droplets or the ink drying in the discharge portions, resulting from exposure of the recording head to the air flow generated by the cooling fan, and it is therefore possible to activate the cooling fan even in the course of a recording operation and to increase the amount of air flow of the cooling fan.

The recording apparatus of the foregoing embodiments is capable of realizing stable ink discharge even in future recording heads in which the amount of heat generated will be increased.

Figure 14:
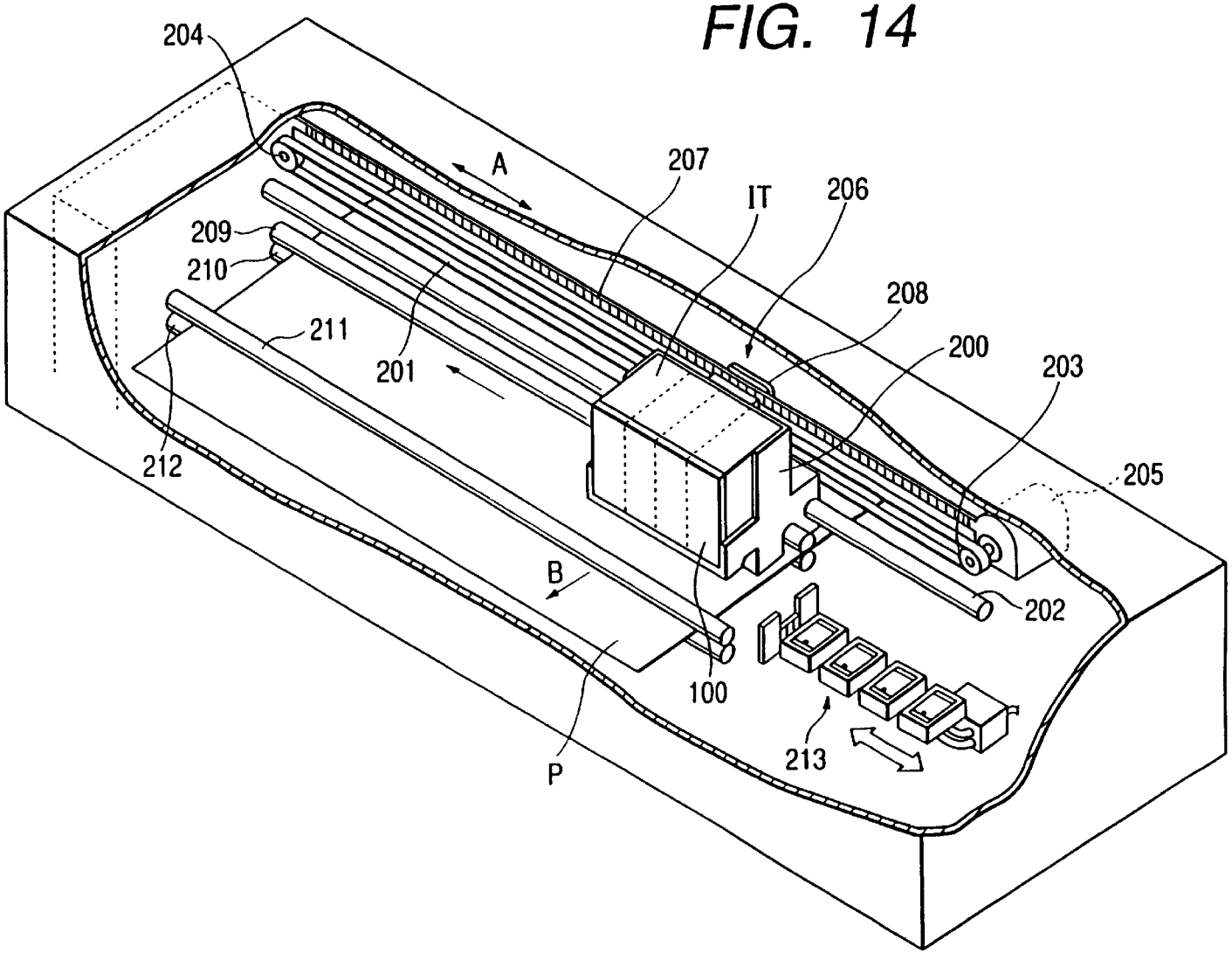
FIG. 14 is a partially cut-off perspective view of a conventional serial ink jet recording apparatus.

FIG. 14 is a partially cut-off perspective view of an ink jet recording apparatus provided in the recording head of the present invention. Referring to FIG. 14, ink tanks IT and a recording head 100 are mounted on a carriage 200. The ink tanks IT are detachably mounted on the recording head 100.

The carriage 200 is fixed to an endless belt 201 and is rendered movable among a guide shaft 202. The endless belt 201 is supported by pullies 203, 204. The pulley 203 is fixed to the driving shaft of a carriage driving motor 205, rotation of which causes a scanning motion of the carriage 200 in a reciprocating direction (indicated by arrow A in FIG. 14) along the guide shaft 202.

The recording head 100 is opposed to a recording paper P constituting the recording medium, and is provided with plural ink discharge ports on a surface opposed to the paper P. The plural ink discharge ports are arranged parallel to the conveying direction (indicated by arrow B in FIG. 14) of the recording paper P. The ink discharge ports communicate, respectively through different ink flow paths, with a common liquid chamber (not shown) into which ink is supplied from the ink tank IT. Corresponding to each ink discharge port, there is provided an electrothermal converting member for generating thermal energy for ink discharge, and electric pulses corresponding to drive data are applied to the electrothermal converting members to generate film boiling and the ink is discharged from the discharge ports by the growth of bubbles generated by the film boiling.

In order to detect the moving position of the carriage 200 there is provided a linear encoder 206, and a linear scale 207 is provided along the moving direction of the carriage 200. The linear scale 207 is provided with slits at a pitch of about 1200 slits per inch. On the other hand, the carriage 200 is provided with a slit detecting system 208, for example, having a light emitting unit and a light sensor, and a signal processing circuit. As the carriage 200 moves, the encoder 206 generates a discharge timing signal indicating the timing of ink discharge and carriage positional information. By discharging ink at each detection of the slit of the linear scale 207 by the slit detecting system 208, there can be executed printing with a resolution of 1200 dpi in the main scanning direction.

The recording paper P is conveyed intermittently in the direction B perpendicular to the scanning direction of the carriage 200. Paired rollers 209, 210 at the upstream side and paired rollers 211, 212 at the downstream side support the recording paper P and give a constant tension thereto, thereby conveying the recording paper P with flatness with respect to the head surface of the recording head 100. The driving power to the paired rollers is provided by an unrepresented paper conveying motor.

In the ink jet recording apparatus of the above-described configuration, the recording is made on the entire recording paper P by alternately repeating the recording of a width of arrangement of the ink discharge ports on the recording head 100 with the movement of the carriage 200 and the conveying of the recording paper P.

The carriage 200 stops at a home position at the start of recording and whenever required in the course of the recording operation. In such home position there is provided a cap member 213 for capping the discharge face of the head, and the cap member 213 is provided with suction recovery means (not shown) for forcibly sucking ink from the discharge ports, thereby preventing the clogging of the discharge ports. In FIG. 14, the recording head is shown only schematically, without detailed structure, in order to explain the recording apparatus.

What is claimed is:

1. A liquid discharge recording head adapted to execute recording by moving in opposed relationship to a recording medium and by discharging liquid from a discharge port, comprising:

a discharge portion substrate provided with thermal energy generating means capable of generating thermal energy to be used for ink discharge;

a heat dissipating substrate positioned substantially parallel and adjacent to said discharge portion substrate; and a space communicable with the atmospheric air, at a rear surface of said heat dissipating substrate, opposite to a surface at a side of which said discharge portion substrate is positioned, wherein said space includes an inclined portion so formed that a cross-section of said space decreases toward an interior thereof in a moving direction of said liquid discharge recording head.

2. A liquid discharge recording head according to claim 1, wherein said heat dissipating substrate is plate shaped and is opposed to said discharge portion substrate, and wherein a surface of said discharge portion substrate having a largest area is opposed to a surface of said heat dissipating substrate having a largest area.

3. A liquid discharge recording head according to claim 1, wherein said heat dissipating substrate is positioned substantially horizontally with respect to a moving direction of said liquid discharge recording head.

4. A liquid discharge recording head according to claim 1, wherein said space includes an inclined portion which is inclined externally upwards in a moving direction of said liquid discharge recording head.

5. A liquid discharge recording head according to claim 1, wherein said space includes a rectifying portion for guiding an air flow in said space.

6. A liquid discharge recording head according to claim 1, wherein said space extends in a moving direction of said liquid discharge recording head.

7. A liquid discharge recording apparatus provided with a carriage capable of supporting the liquid discharge recording head according to claim 1, comprising an aperture capable of taking in atmospheric air at a side in a moving direction of said carriage.

8. A liquid discharge recording apparatus provided with a carriage capable of supporting a liquid discharge recording head adapted to execute recording by moving in opposed relationship to a recording medium and by discharging liquid from a discharge port by thermal energy generating means capable of generating thermal energy to be used for ink discharge, said liquid discharge recording head comprising a discharge portion substrate provided with said thermal energy generating means, a heat dissipating substrate positioned substantially parallel and adjacent to said discharge portion substrate, and a duct communicable with the atmospheric air, positioned at a rear surface of said heat dissipating substrate, opposite to a surface at a side of which said discharge portion substrate is positioned and opened in a direction along a moving direction of said liquid discharge recording head.

9. A liquid discharge recording apparatus according to claim 8, wherein said heat dissipating substrate is positioned substantially horizontally with respect to a moving direction of said liquid discharge recording head.

10. A liquid discharge recording apparatus according to claim 8, wherein a flow path for supplying said discharge port with liquid from an ink tank mounted on said liquid discharge recording head extends through the duct of said recording head.

11. A liquid discharge recording apparatus according to claim 8, wherein said heat dissipating substrate is plate shaped and is opposed to said discharge portion substrate, and wherein a surface of said discharge portion substrate having a largest area is opposed to a surface of said heat dissipating substrate having a largest area.

12. A liquid discharge recording apparatus according to claim 8, further comprising a heat accumulating member adjacent to said heat dissipating substrate.

13. A liquid discharge recording apparatus according to claim 12, wherein said heat accumulating member has an irregular shape.

14. A liquid discharge recording apparatus according to claim 8, further comprising a cooling fan for cooling the recording head, wherein said liquid discharge recording head is positioned opposed to said cooling fan so as to facilitate the introduction of air into said duct by said cooling fan.

15. A liquid discharge recording apparatus according to claim 14, further comprising:

a temperature sensor provided in said liquid discharge recording head; and control means for controlling recording by said liquid discharge recording head, movement of said liquid discharge recording head and driving of said cooling fan;

wherein said control means is adapted, in case a temperature detected by said temperature sensor exceeds a predetermined temperature in the course of a recording operation by said liquid discharge recording head, to interrupt the recording operation, to move said liquid discharge recording head to a predetermined position and, after cooling by the driving of said cooling fan, to re-start the interrupted recording operation by said liquid discharge recording head.

16. A liquid discharge recording apparatus according to claim 8, wherein the carriage includes an atmospheric air entrance communicating with said duct of said liquid discharge recording head.

17. A liquid discharge recording head adapted to execute recording by moving in opposed relationship to a recording medium and by discharging liquid from a discharge port, comprising:

a discharge portion substrate provided with thermal energy generating means capable of generating thermal energy to be used for ink discharge;

a heat dissipating substrate in contact with said discharge portion substrate wherein a surface of said discharge portion substrate having a largest area is in contact with a surface of said heat dissipating substrate having a largest area; and a space communicable with the atmospheric air, at a rear surface of said heat dissipating substrate, opposite to a surface at a side of which said discharge portion substrate is positioned, wherein said space extends in a moving direction of said liquid discharge recording head.

18. A liquid discharge recording head for recording by moving in opposition to a recording medium and by discharging liquid from a discharge port, comprising:

a substrate having a thermal energy generating means capable of generating thermal energy used for discharging liquid; and a space portion, communicable with the atmospheric air, provided on a rear side of said substrate, opposed to a surface of said substrate on which said thermal energy generating means is disposed, wherein said space portion extends in a moving direction of said liquid discharge recording head.

* * * * *